US006121731A

United States Patent [19]

Kanazawa et al.

[11] Patent Number: 6,121,731

[45] Date of Patent: Sep. 19, 2000

[54] DISCHARGE LAMP LIGHTING SYSTEM WITH OVERCURRENT PROTECTION FOR AN INVERTER SWITCH OR SWITCHES

[75] Inventors: Masaki Kanazawa, Koganei; Hironobu Sou, Tokorozawa; Hideki Nakamichi, Asaka; Nanjou Aoike, Yokohama, all of Japan

[73] Assignee: Sanken Electric Co., Ltd., Saitama-ken, Japan

[21] Appl. No.: 09/252,463

[22] Filed: Feb. 18, 1999

[30] Foreign Application Priority Data

Feb. 26, 1998 [JP] Japan ..... 10-062262

[51] Int. Cl.[7] ..... G05F 1/00

[52] U.S. Cl. ..... 315/194; 315/307; 315/291; 315/247; 315/224; 315/209 R; 315/DIG. 7

[58] Field of Search ..... 315/307, 291, 315/194, 247, 209 R, 224, 276, DIG. 4, DIG. 7

[56] References Cited

U.S. PATENT DOCUMENTS

| | | | |
|---|---|---|---|
| 5,003,230 | 3/1991 | Wong et al. | 315/279 |
| 5,111,118 | 5/1992 | Fellows et al. | 315/307 |
| 5,798,616 | 8/1998 | Takehara et al. | 315/247 |
| 5,804,924 | 9/1998 | Ohnishi et al. | 315/160 |

FOREIGN PATENT DOCUMENTS 2627740 4/1997 Japan .

*Primary Examiner*—Haissa Philogene
*Attorney, Agent, or Firm*—Woodcock Washburn Kurtz Mackiewicz & Norris LLP

[57] ABSTRACT

A lighting system for a fluorescent lamp includes an inverter circuit to which is connected a load circuit including a resonant circuit of an inductor and a capacitor in serial connection, with a lamp connected in parallel with the capacitor. An inversely frequency dependent voltage is applied between the lamp electrodes according to a predefined resonance characteristic such that the resonance frequency is less than a discharge start frequency at which the lamp is to start glowing. For lighting up the lamp the frequency of the inverter output voltage is changed from a first frequency that is higher than the discharge start frequency to a second frequency that is less than the resonance frequency. If the lamp accidentally goes off, the current flowing through the load circuit will advance out of phase with the inverter output voltage, possibly resulting in the destruction of the inverter switch or switches due to overcurrent. This danger is precluded by constantly monitoring the phase of the load current and, in event the load current is found to be in phase advance, by making the inverter output frequency higher than the resonance frequency of the resonant circuit and thereby delaying the phase of the load current.

20 Claims, 17 Drawing Sheets

DISCHARGE LAMP LIGHTING SYSTEM WITH OVERCURRENT PROTECTION FOR AN INVERTER SWITCH OR SWITCHES

BACKGROUND OF THE INVENTION

This invention relates to lighting systems for discharge lamps, and pertains more particularly to a lighting system having an inverter and associated means for control of the inverter output frequency for harmlessly and quickly lighting up a discharge lamp as typified by a fluorescent lamp. Still more particularly, the invention concerns, in such a lamp lighting system, how to protect the switch or switches of the inverter against destruction due to overcurrent.

It has been known and practiced conventionally to incorporate an inverter in discharge lamp lighting systems for higher lighting efficiency, among other purposes, as disclosed for example in Japanese Patent No. 2627740. Such known lighting systems having an inverter are alike in including a resonant circuit of an inductor and a capacitor connected in series between the pair of output terminals of the inverter, with the discharge lamp connected in parallel with the capacitor. The discharge lamp has its pair of filamentary electrodes connected in series with the capacitor in order to be preheated before being lit up.

The magnitude of the current flowing through the LC resonant circuit is frequency dependent, growing to a maximum at a resonance frequency and diminishing in both increasing and decreasing directions from that frequency, because both inductor and capacitor of the resonant circuit inherently possess resistive components. Consequently, the voltage across the capacitor also maximizes at the resonance frequency and diminishes in both directions from that frequency.

As is well known, an electron radiating substance is coated on the filamentary electrodes of the discharge lamp. In a lighting system including an inverter, the lamp electrodes are preheated as aforesaid, instead of being suddenly subjected to a voltage high enough to initiate an electric discharge therebetween, in order to prevent the electron radiating substance from vaporizing or scattering away from the filaments. The preheating of the lamp electrodes are accomplished by maintaining the voltage across the capacitor at a constant value less than the voltages applied during the subsequent lightup period. The lamp is then lit up by decrementing the inverter output frequency and thereby incrementing the voltage across the capacitor until the lamp starts glowing with the commencement of a discharge between the lamp electrodes.

In discharge lamp lighting systems of the above known constructions, there have been a problem left unsolved in connection with the switch, or the pair of switches, of the inverter. An abnormally high current would flow through the inverter switch or switches if the current of the LC resonant circuit were in phase advance with respect to the inverter output voltage. The inverter switch or switches would be ruined with the repeated flow of such overcurrent.

It is known, however, that the LC resonant circuit operates as inductive reactance at frequencies above the resonance frequency, and as capacitive reactance at frequencies below the resonance frequency. The current flowing through the resonant circuit is in phase delay when it is operating as inductive reactance, and in phase advance when it is operating as capacitive reactance. The inverter is therefore driven so as to provide output frequencies above the resonance frequency of the resonant circuit in order to preclude the danger of destruction of the inverter switch or switches.

As has been mentioned, the lamp is lit up by decrementing the inverter output frequency from a predetermined value $f_1$. in FIG. 6 of the drawings attached hereto) above the resonance frequency ($f_0$) until the lamp starts glowing (as at $f_2$). The voltage required for holding the lamp glowing can be less than its discharge start voltage, so that the inverter output frequency is further reduced after the lamp has been lit up, and fixed at a value ($f_3$) that is less than the resonance frequency ($f_0$) of the LC resonant circuit. However, on being lit up, the discharge lamp becomes electrically connected in parallel with the resonant capacitor. The resonant frequency ($f_4$) of the resulting resonant circuit, inclusive of the glowing discharge lamp, is less than that ($f_0$) of the LC resonant circuit exclusive of the lamp and, indeed, the normal output frequency ($f_3$) of the inverter. Thus the inverter output frequency ($f_3$) remains higher than the resonant frequency ($f_4$) when the lamp is glowing, too, holding the current of the resonant circuit in phase delay and so saving the inverter switch or switches from overcurrent destruction.

The statement of the preceding paragraph holds true, however, only in the case where the discharge lamp is in good working state. Near the end of its service life in particular, the lamp may accidentally go off while being energized with the inverter output frequency at the normal value ($f_3$). Thereupon this normal frequency will become less than the resonant frequency ($f_0$) which is then determined by the LC resonant circuit exclusive of the discharge lamp. Conventionally, the resulting phase advance of the resonant circuit current have caused the flow of overcurrent to the inverter switch or switches, destroying them in the worst case.

The same accident has occurred with totally malfunctioning or used-up discharge lamps that remain unlit when the inverter output frequency is reduced as above for lighting them up.

An obvious remedy to this inconvenience might seem to hold the inverter output frequency above the resonant frequency ($f_0$) of the resonant circuit exclusive of the discharge lamp when the lamp is unlit, and hence to prevent current flow through the resonant circuit in phase advance. This solution is unsatisfactory, bringing about other inconveniences, because of the narrowing of the inverter output frequency range, or of the voltage range of the resonant capacitor, that could be utilized for lighting up the lamp.

SUMMARY OF THE INVENTION

It is therefore among the objects of this invention to save, in a discharge lamp lighting system including an inverter, the inverter switch or switches from overcurrent destruction when the lamp accidentally goes off, or remains unlit, while being applied with the inverter output voltage in order to be lit up.

Briefly, the present invention may be summarized as a discharge lamp lighting system providing for overcurrent protection of an inverter switch or switches. Included is an inverter circuit to which is connected a load circuit including a resonant circuit having a capacitor with which a discharge lamp is to be connected in parallel, in order to cause an inversely frequency dependent voltage to be applied between a pair of electrodes of the lamp according to a predefined resonance characteristic. The resonant circuit has a resonance frequency that is less than a discharge start frequency at which the lamp is to start glowing. Also connected to the inverter circuit are inverter control means for lighting up the lamp by changing the frequency of the output voltage of the inverter circuit from a first frequency which is higher than the discharge start frequency to a second frequency which is less than the resonance frequency of the resonant circuit, and for holding the lamp glowing by maintaining the output voltage of the inverter circuit at the second frequency.

Whether the lamp is properly lit up or not is detectable from the phase relationship between the inverter output voltage and a current flowing through the load circuit. Thus the lamp lighting system according to the invention additionally comprises phase advance detector means for ascertaining whether or not a current flowing through the load circuit is in phase advance with respect to the inverter output voltage. Over-riding frequency control means are connected between the phase advance detector means and the inverter control means for causing the inverter control means to make the inverter output frequency higher than the resource frequency of the resonant circuit when the current flowing through the load circuit is ascertained to be in phase advance or phase lead with respect to the output voltage of the inverter circuit.

Since the load current becomes advanced in phase when the discharge lamp accidentally goes off, or remains unlit while being applied with an increasing voltage past its discharge start voltage, the inverter output frequency is automatically readjusted to bring the load current back into phase delay or phase lag compared to the inverter output voltage. The switch or switches included in the inverter circuit can thus be protected from destruction due to overcurrent.

Further, if the lamp goes off while being energized with the inverter output voltage at the noted second frequency ($f_3$ in FIG. 6), which is less than the resonance frequency ($f_0$) of the resonant circuit exclusive of the lamp but higher than the resonance frequency ($f_4$) of the resonant circuit inclusive of the lamp, the inverter output frequency is automatically made higher than the resonance frequency ($f_0$) exclusive of the lamp. The load current is therefore not to be left in phase advance for any such extended period of time as to incur damage to the inverter switch or switches.

It is also to be appreciated that, for lighting up the lamp, the inverter output frequency is invariably decreased linearly from the first frequency ($f_1$) to a frequency less than the resonance frequency ($f_0$). Consequently, even if the lamp fails to start glowing at the prescribed discharge start frequency ($f_2$), it may do so as the frequency is further reduced with the consequent increase in the voltage across the lamp to a value higher than that at the discharge start frequency.

The above and other features and advantages of this invention and the manner of realizing them will become more apparent, and the invention itself will best be understood, from a study of the following description and attached claims, with reference had to the attached drawings showing some preferable embodiments of the invention.

DESCRIPTION OF THE PREFERRED EMBODIMENTS

Figure 1:
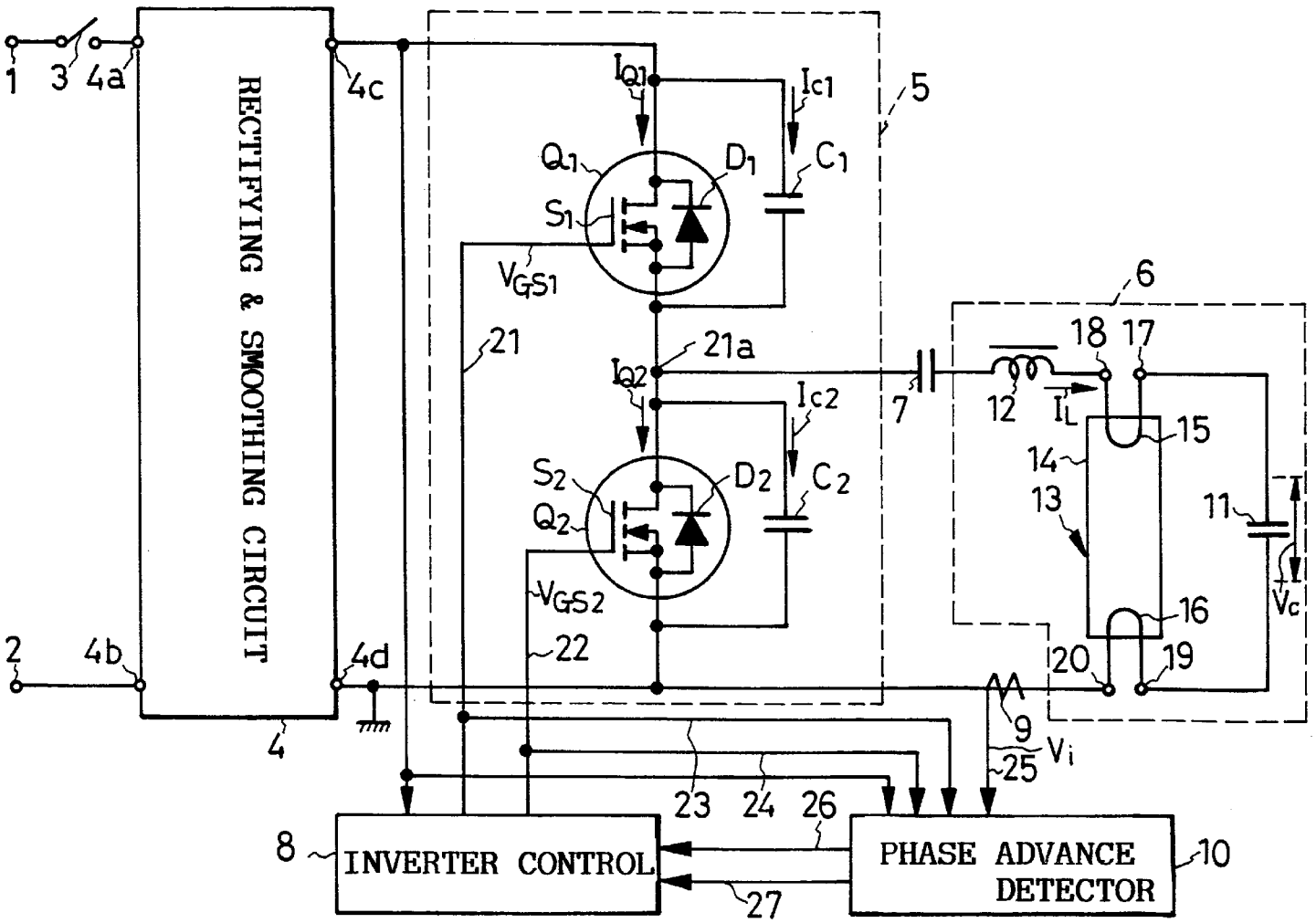
FIG. 1 is a schematic electrical diagram, partly in block form, of the discharge lamp lighting system embodying the principles of the present invention.

The invention will now be described more specifically in terms of the first preferred form of discharge lamp lighting system illustrated in its entirety in FIG. 1. Herein shown adapted for lighting up a familiar fluorescent lamp 13 by being powered from a pair of commercial alternating current supply terminals 1 and 2 via a power switch 3, the lighting system broadly comprises a rectifying and smoothing circuit 4 connected to the a.c. supply terminals 2 and 3 for providing a direct current, an inverter circuit 5 for reconverting the d.c. input from the rectifying and smoothing circuit into an a.c. output, a load circuit 6 including the fluorescent lamp 13 and connected to the inverter circuit 5 via a coupling capacitor 7, an inverter control circuit 8 for controllaby driving the inverter circuit 5, and a phase advance detector circuit 10 connected to the load circuit 6 via a current detector 9 for ascertaining whether the current flowing through the load circuit is in phase advance with respect to the inverter output voltage.

Intended to serve as d.c. power supply of the lamp lighting system, the rectifying and smoothing circuit 4 is shown to have a first input 4*a* connected to one commercial a.c. supply terminal 1 via the power switch 3, and a second input 4*b* coupled directly to the other a.c. supply terminal 2. Conventionally comprising a diode rectifier circuit and a smoothing capacitor, both not shown, the rectifying and smoothing circuit 5 provides a unidirectional voltage between a pair of d.c. supply terminals 4*c* and 4*d*.

The inverter circuit 5 comprises a pair of electronic switches $Q_1$, and $Q_2$ connected in series with each other between the pair of d.c. output terminals 4*c* and 4*d* of the rectifying and smoothing circuit 4, and capacitors $C_1$ and $C_2$ connected in parallel one with each switch. The electronic switches $Q_1$ and $Q_2$ are shown as well known metal oxide semiconductor field-effect transistors (MOS FETs) each having a source electrode connected to a substrate region and essentially comprising a FET switch section $S_1$ or $S_2$ and a diode section $D_1$ or $D_2$ inversely connected in parallel therewith. Alternately turned on and off, the pair of MOS FET switches $Q_1$ and $Q_2$ conventionally functions to translate the d.c. output voltage of the rectifying and smoothing circuit 4 into an a.c. voltage for application to the load circuit 6. The capacitors $C_1$ and $C_2$ function primarily to prevent rapid rise in the drain-source voltages $V_{DS}$ of the switches $Q_1$ and $Q_2$ when they are turned off, thereby lessening switching losses.

Notwithstanding the showing of FIG. 1 the switch sections $S_1$ and $S_2$ and the diode sections $D_1$ and $D_2$ could be parallel connections of discrete parts. Also, the switch sections could be bipolar transistors rather than FETs.

The load circuit 6 includes a resonance capacitor 11 and a resonance inductor 12 in addition to the fluorescent lamp 13. The fluorescent lamp 13 is of familiar design having a tubular envelope 14 of vitreous material with a fluorescent coating on its inner surface, and a pair of filamentary electrodes 15 and 16 at the opposite ends of the envelope. Both electrodes 15 and 16 conventionally bear electron radiating coatings. The electrode 15 is shown connected between a pair of terminals 17 and 18, and the other electrode 16 between another pair of terminals 19 and 20. It is understood that the fluorescent lamp 13 is replaceable, being coupled to the terminals 17–20 through conventional plug-and-socket connections.

The resonance capacitor 11 is connected both to the terminal 17 on one extremity of one filamentary electrode 15 of the lamp 13 and to the terminal 19 on one extremity of the other lamp electrode 16. Thus the resonance capacitor 7 is in series with the lamp electrodes 15 and 16 and in parallel with the discharge path between these lamp electrodes. Consequently, the voltage Vc across the capacitor 11 can be impressed between the pair of lamp electrodes 15 and 16.

Shown as a coil with a core, the resonance inductor 12 is connected via the coupling capacitor 7 between the junction 21*a* of the inverter switches $Q_1$ and $Q_2$ and the lamp terminal 18. The lamp terminal 20 is connected to the source electrode of the second MOS FET switch $Q_2$ of the inverter circuit 5. The resonance capacitor 11 and the resonance inductor 12 are therefore interconnected in series, forming a serial resonant circuit. Additionally, the inductor 12 is connected in series with the fluorescent lamp 13 when the latter is glowing. This inductor could be connected between the terminal 20 of the lamp 13 and the source of the second MOS FET switch $Q_2$ of the inverter circuit 5. Irrespective of whether the lamp 13 is lit or unlit, a current flows through the lamp electrodes 15 and 16 as long as the power switch 3 is closed, because the serial circuit is always completed which comprises the inductor 12, first lamp electrode 15, resonance capacitor 11 and second lamp electrode 16. Thus the lamp electrodes 15 and 16 can be preheated by such current flow before the lamp is lit up.

Figure 7:
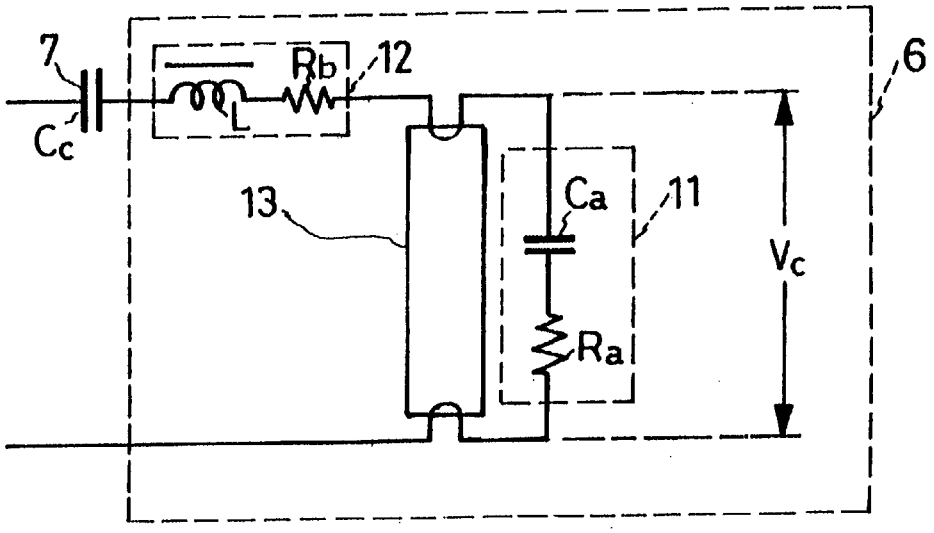
FIG. 7 is an equivalent diagram of the load circuit of the FIG. 1 lamp lighting system.

As indicated in FIG. 7 showing a circuit equivalent to the load circuit 6, the resonance capacitor 11 can be thought of as a serial connection of capacitance Ca and internal resistance Ra, and the resonance inductor 12 as a serial connection of inductance L and internal resistance Rb. The lamp 13 when unlit has its pair of filamentary electrodes electrically disconnected from each other, so that it is only the capacitor 11 and inductor 12 that determine the resonance frequency of the serial resonance circuit during that time. When the lamp 13 is glowing, on the other hand, the resonance frequency is determined not only by the capacitor 11 and inductor 12 but also by the lamp, its electrodes being now electrically interconnected.

Figure 6:
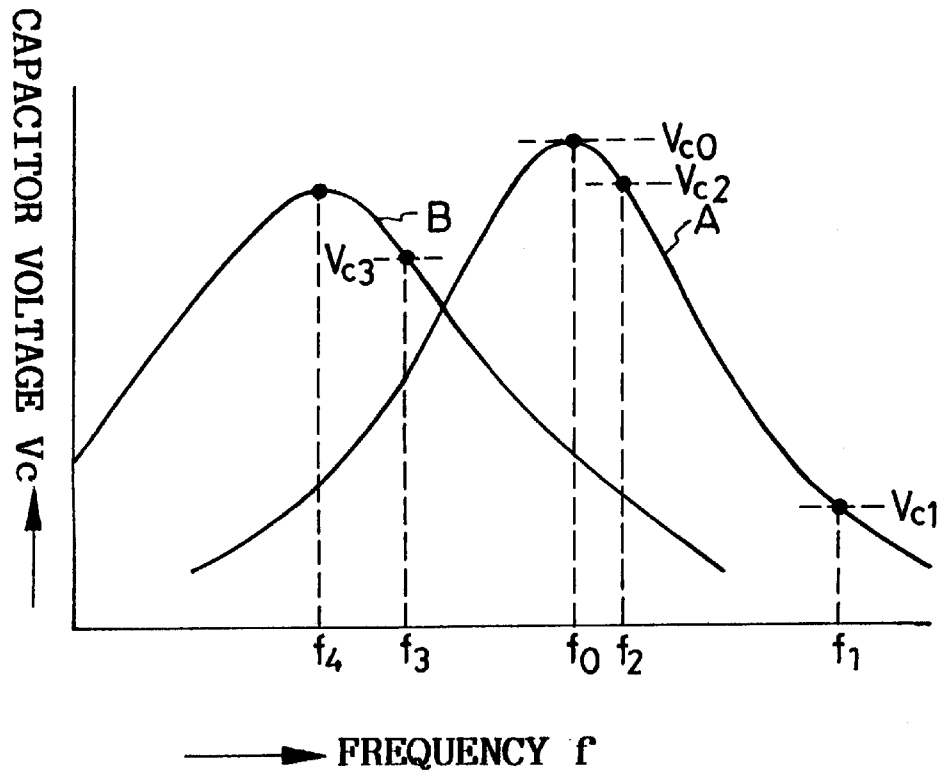
FIG. 6 is a graph plotting the curves of the resonance capacitor voltage against the inverter output frequency when the lamp is lit and unlit, in the FIG. 1 discharge lamp lighting system.

Graphically represented in FIG. 6 are the relationships between the frequency f of the output voltage of the inverter circuit 5 and the voltage Vc across the resonance capacitor 11. The curve A is the f-Vc characteristic when the lamp 13 is unlit, and the curve B that when the lamp is glowing. The curves A and B indicate that the capacitor voltage Vc is frequency dependent, being the highest at the resonance frequency $f_0$ when the lamp is unlit and at the resonance frequency $f_1$ when the lamp is lit. Below these resonance frequencies the capacitor voltage Vc is in direct proportion to the inverter output frequency f and, above that frequency, in inverse proportion thereto. The electric power supplied from inverter circuit 5 to load circuit 6 has also frequency dependencies similar to the curves A and B.

The capacitance Cc, FIG. 7, of the coupling capacitor 7 is greater than the capacitance Ca of the resonance capacitor 11, so much so that the resonance frequency of the circuit comprised of the load circuit 6 and the coupling capacitor 7 is nearly the same as that of only the load circuit 6. In short the capacitance Cc of the coupling capacitor 7 hardly affects the resonance frequency.

The present invention utilizes the frequency range of the curve A above the resonance frequency $f_0$, where the capacitor voltage Vc is inversely dependent upon the inverter output frequency f, for preheating and lighting up the lamp 13. The lamp is to start glowing at $f_2$, and is to be kept glowing at $f_3$ which is intermediate the resonance frequencies $f_1$ and $f_4$ of the curves A and B.

The configurations of the inverter control circuit 8 and phase advance detector circuit 10, to be set forth subsequently with reference to FIGS. 2–4, will be better understood by first studying in connection with FIGS. 5 and 6 how the lamp 13 is lit up in the instant embodiment of the invention.

Figure 5:
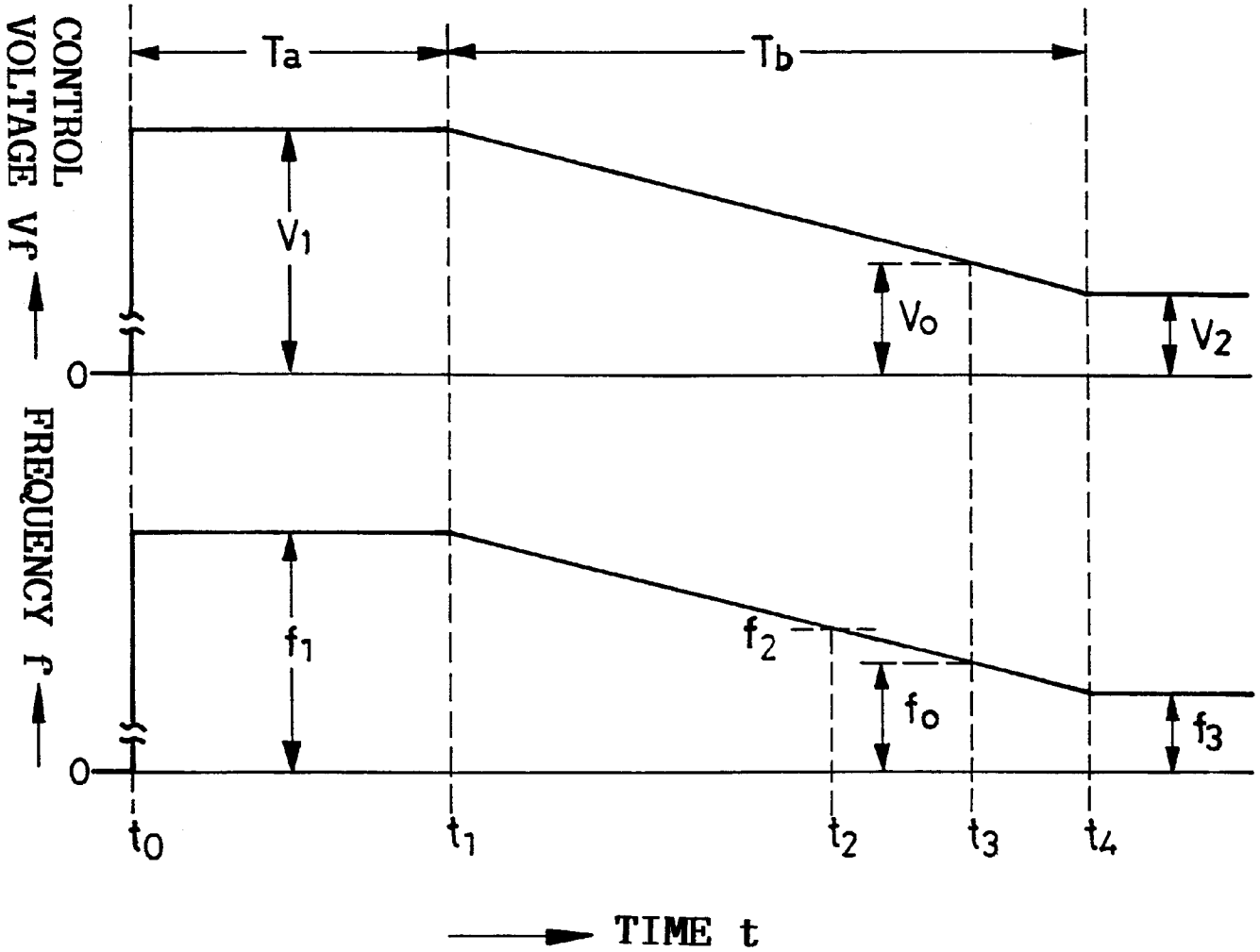
FIG. 5 is a diagram of the waveforms of the output voltage of the FIG. 3 frequency control signal generator circuit, and the frequency of the output voltage of FIG. 1 inverter circuit.

In the bottom half of FIG. 5 is plotted the curve of the frequency f of the a.c. output produced by the inverter circuit 5 for preheating and lighting up the lamp 13, against time t. As the power switch 3, FIG. 1, is closed at a moment $t_0$ in time, the inverter circuit 5 is caused to supply to the load circuit 6 the a.c. output of the frequency $f_1$ of which, as indicated in FIG. 6, the corresponding resonance capacitor voltage $Vc_1$ is significantly less than the voltage $Vc_2$ at which the lamp 13 is designed to start an electric discharge. The lamp 13 will therefore remain unlit, but its filaments 15 and 16 will be preheated by current flow through the resonance circuit of capacitor 11 and inductor 12. The inverter output is maintained at this preheat frequency $f_1$ during a prescribed preheat period Ta, from to $t_0$ $t_1$, of, say, 500–1000 milliseconds. The preheat frequency $f_1$ may be set somewhere between 80 and 90 kilohertz.

The inverter output frequency need not be constant throughout the preheat period Ta; instead, it may be decremented with time in a range above $f_1$.

During the subsequent lightup period Tb, from $t_1$ to $t_4$, the inverter output frequency is dropped from $f_1$ to $f_3$, either linearly, as depicted in FIG. 5, or in discrete steps, past the intended discharge start frequency $f_2$ and the resonance frequency $f_0$ of the period the lamp is unlit. If normal, the lamp 13 will start glowing at the discharge start frequency $f_2$, or at $t_2$ in FIG. 5, or thereabouts. Even if the lamp fails to start glowing at $f_2$ because of fluctuations in performance, the inverter output frequency will continue dropping toward the resonance frequency $f_0$, with the consequent continuation of the rise in capacitor voltage Vc toward the peak value Vca The lamp will start a discharge by $t_3$ when the resonance frequency $f_0$ is reached, $t_3$ being earlier than $t_4$, if the performance fluctuations are within the range of allowance.

As has been set forth in connection with the prior art, the lamp on glowing will become electrically connected in parallel with the resonance capacitor 11, causing a change in the frequency dependence of the capacitor voltage Vc from curve A to curve B in FIG. 6. The inverter output frequency is dropped to $f_3$ at $t_4$ and fixed at that value as long as the lamp is held glowing thereafter. The frequency $f_3$ is such that the corresponding capacitor voltage $Vc_3$ is less than the discharge start voltage $Vc_2$.

Near the end of its useful life in particular, the lamp 13 may become unlit while being driven at the inverter output frequency $f_3$, again converting the frequency dependence of the capacitor voltage Vc from curve B back to curve A. Thereupon the frequency $f_3$ would be less than the resonance frequency $f_0$ of the resonant circuit exclusive of the lamp 13. The current $I_L$ flowing through the load circuit 6 would then be in phase advance with respect to the inverter output, because then the load circuit 6 would be capacitive reactance. Overcurrent would then flow through the inverter switches $Q_1$ and $Q_2$, possibly to their destruction, in the absence of the novel inverter switch control means of the instant invention to be set forth hereafter.

With reference back to FIG. 1 the inverter control circuit 8 incorporates novel circuit means according to the invention for controlling the inverter switches $Q_1$ and $Q_2$ not only when the lamp 13 is functioning normally but also, in cooperation with the current detector 9 and phase advance detector circuit 10, when the lamp goes off after being lit up as above. The inverter control circuit 8 has two outputs connected to the gate electrodes of the inverter switches $Q_1$ and $Q_2$ by way of conductors 21 and 22 and to the phase advance detector circuit 10 by way of conductors 23 and 24. It is understood that the inverter control circuit 8 is additionally coupled to the source electrodes of the inverter switches $Q_1$ and $Q_2$ for supplying thereto gate-source voltage signals $V_{GS1}$ and $V_{GS2}$ as inverter switch control signals.

The current detector 9 is coupled to the conductor through which there flows the load current $I_L$ and is connected to the phase advance detector circuit 10 by way of a conductor 25. A current transformer is a preferred example of the current detector 9, although other devices such as a magnetoelectric converter might be employed.

Inputting the load current $I_L$ and the gate-source voltage signals $V_{GS1}$ and $VGS_2$, the phase advance detector circuit 10 constantly monitors whether the load current is in phase advance with respect to the inverter output voltage. The resulting outputs from the phase advance detector circuit 10 are fed over conductors 26 and 27 to the inverter control circuit 8.

Figure 2:
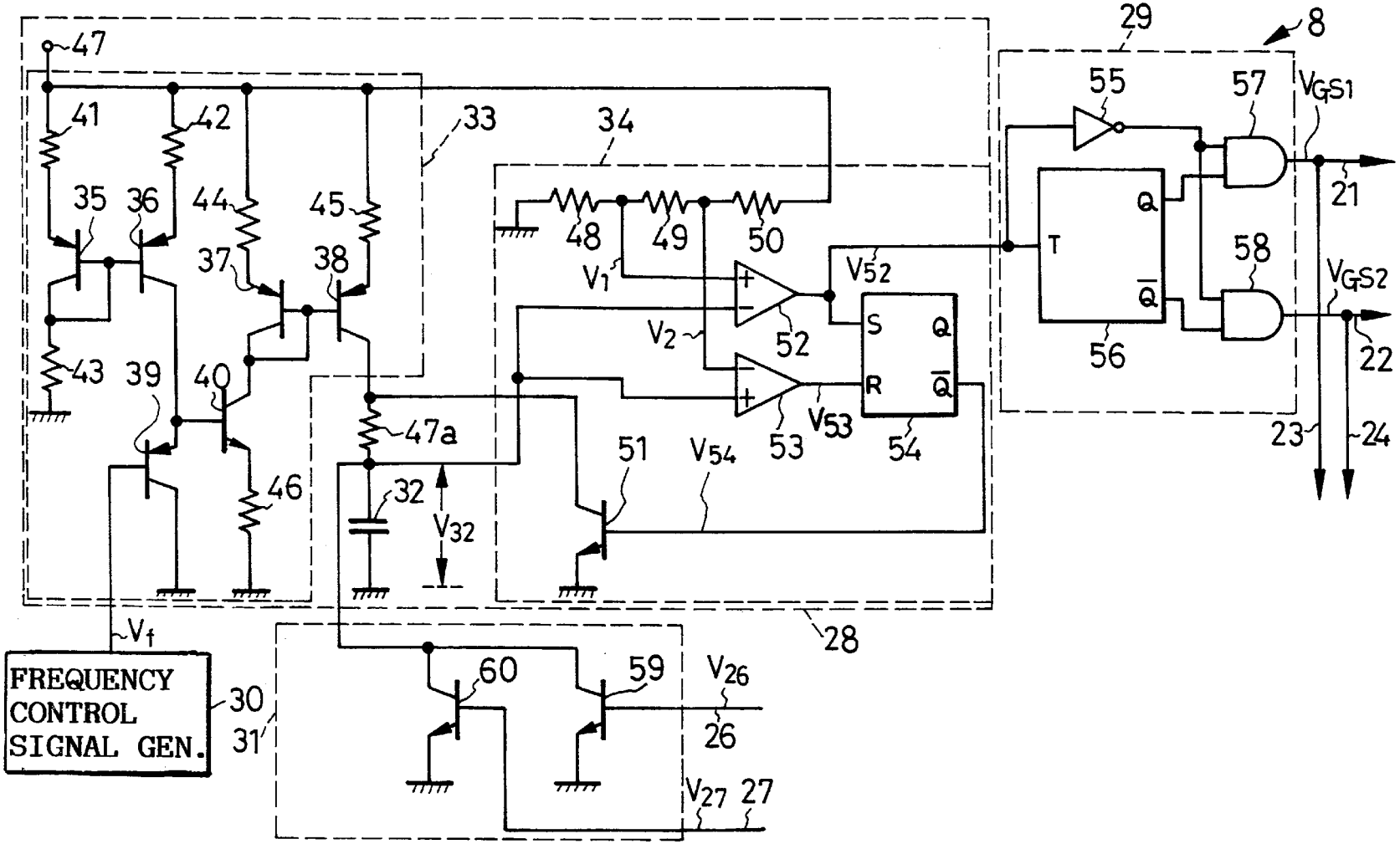
FIG. 2 is a schematic electrical diagram showing in more detail the inverter control circuit of the FIG. 1 discharge lamp lighting system.

Reference is now invited to FIG. 2 for detailed discussion of the inverter control circuit 8. Broadly, this circuit 8 may be considered the combination of a variable frequency pulse generator circuit 28, a switch control signal forming circuit 29, a frequency control signal generator circuit 30, and an overriding frequency control circuit 31.

The variable frequency pulse generator circuit 28 is essentially a voltage controlled oscillator, comprising a capacitor 32 for producing a triangular wave, a charging circuit 33 for the capacitor 32, and a discharging and wave shaping circuit 34, in order to generate pulses at a repetition rate depending upon the frequency control voltage signal fed from the frequency control signal generator circuit 30.

The charging circuit 33 of the pulse generator circuit 28 comprises a pair of transistors 35 and 36 constituting a Miller circuit, another pair of transistors 37 and 38 constituting another Miller circuit, two current control transistors 39 and 40, and six resistors 41, 42, 43, 44, 45 and 46. The transistors 35 and 36 are both of PNP type, having their emitters connected to a supply terminal 47 via resistors 41 and 42, respectively. It is understood that the supply terminal is connected to a control power supply, not shown, which is connected to the rectifying and smoothing circuit 4, FIG. 1. The bases of the transistors 35 and 36 are interconnected and connected to the collector of the transistor 35, which collector is grounded via the resistor 43. The collector of the other transistor 36 is grounded via the transistor 39.

Constituting another Miller circuit, the transistors 37 and 38 are also both of PNP type, also having their emitters connected to the supply terminal 47 via the resistors 44 and 45, respectively, and their bases jointly connected to the collector of the transistor 37, which collector is grounded via the transistor 40 and resistor 46. The collector of the other transistor 38 is connected to the capacitor 32 via a current limiting resistor **47*a* which is shown external to the charging circuit 33. The capacitor 32 has another terminal grounded. Of NPN type, the transistor 40 has its base connected to the collector of the transistor 36, so that the transistor 39 serves as a variable resistance bypass for the base current of the transistor 40**.

Figure 12:
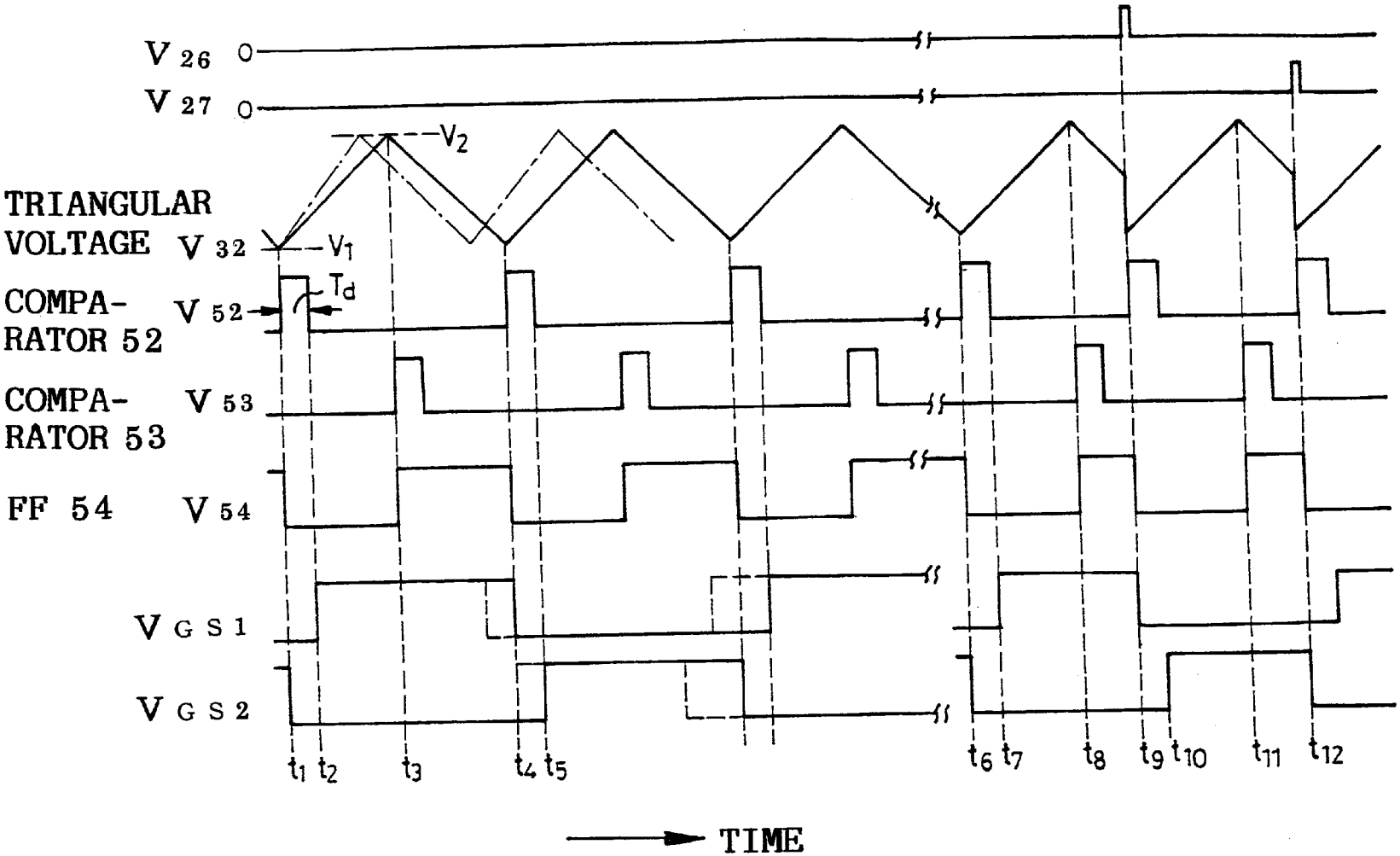
FIG. 12 is a diagram of waveforms that appear at various parts of the FIG. 2 inverter control circuit.

The discharging and wave shaping circuit 34 comprises three resistors 48, 49 and 50, a discharging transistor 51, two comparators 52 and 53, and an RS flip flop 54. The resistors 48–50 are serially connected between supply terminal 47 and ground for providing two different reference voltages for the comparators 52 and 53. The first comparator 52 has one input connected to the junction between capacitor 32 and resistor **47*a*, and the other input to the junction between the resistors 48 and 49. Thus the first comparator 52 compares the triangular wave voltage $V_{32}$ across the capacitor 32 with the first reference voltage $V_1$ from between the resistors 48 and 49, going high each time the triangular wave voltage crosses the first reference voltage. Having hysteresis, the first comparator 52 provides a series of pulses with a predetermined duration (designated Td in FIG. 12**).

The second comparator 53 has one input connected to the junction between capacitor 32 and resistor 47*a*, and the other input to the junction between the resistors 49 and 50. The second comparator 53 goes high each time the triangular wave voltage $V_{32}$ crosses the second reference voltage $V_2$ from between the resistors 49 and 50, the second reference voltage being higher than the first $V_1$. Also having hysteresis, the second comparator 52 provides pulses of approximately the same duration as that of each first comparator output pulse.

The first comparator 52 delivers its output $V_{52}$ both to the switch control signal forming circuit 29 and to the set input S of the flip flop 54 for discharge control of the capacitor 32. The second comparator 53 delivers its output $V_{53}$ to the reset input R of the flip flop 54. The output $V_{54}$ from the phase-inverted output from the flip flop 54 will therefore go low each time the flip flop is set by the leading edge of a pulse from the first comparator 52, and high each time the flip flop is reset by the leading edge of a pulse from the second comparator 53.

Connected to the base of the transistor 51, the flip flop 54 will cause conduction therethrough while being reset (as from $t_3$ to $t_4$ in FIG. 12), providing a discharge path for the capacitor 32 via the resistor 47*a* Since this discharge circuit has a fixed time constant, the period during which the flip flop 54 stays reset is unchanged. The period during which this flip flop 54 stays set (as from $t_1$ to $t_3$ in FIG. 12), on the other hand, is subject to change as the current charging the capacitor 32 is under control. It will be seen from the foregoing that the first comparator 52 functions as wave shaping circuit for the triangular wave voltage $V_{32}$ and additionally participates in discharge control of the capacitor 32.

The switch control signal forming circuit 29 responds to the pulses $V_{52}$ from the pulse generator circuit 28 by producing the gatesource voltage signals $V_{GS1}$ and $V_{GS2}$ for on/off control of the inverter switches $Q_1$ and $Q_2$, FIG. 1. Included are a NOT circuit 55 and a trigger flip flop 56 which are both connected to the first comparator 52 of the pulse generator circuit 28. Triggered by the leading edges of the output pulses $V_{52}$ from the first comparator 52 (as at $t_3$ and $t_4$ in FIG. 12), the flip flop 56 switches between the two stable states.

Also included in the switch control signal forming circuit 29 are a first AND gate 57 having its two inputs connected to the noninverting output of the flip flop 56 and to the NOT circuit 55, and a second AND gate 58 having its two inputs connected to the inverting output of the flip flop 56 and to the NOT circuit 55. The two AND gates 57 and 58 produces the gate-source voltage signals $V_{GS1}$ and $V_{GS2}$ for delivery both to the switches $Q_1$ and $Q_2$ of the inverter circuit 5, FIG. 5, over the conductors 21 and 22 and to the phase advance detector circuit 10 over the conductors 23 and 24.

The two gate-source voltage signals $V_{GS1}$ and $V_{GS2}$ are so interrelated (FIG. 12) that there are what may be termed "dead times" during which neither of the inverter switches $Q_1$ and $Q_2$ is actuated by these signals. Each dead time, determined by the duration Td of each output pulse from the comparators 52 and 53, should preferably be not less than the time required for the voltage across the capacitors $C_1$ and $C_2$ to become zero by reverse charging.

Shown also in FIG. 2, the overriding frequency control circuit 31 of the inverter control circuit 8 comprises two switches 59 and 60, both shown as transistors, which are connected in parallel with the triangular wave generating capacitor 32 of the pulse generator circuit 28 for its compulsory discharge. The bases of these switching transistors 59 and 60 are connected to the phase advance detector circuit 10, shown in block form in FIG. 1 and yet to be detailed with reference to FIG. 4, by way of the conductors 26 and 27 in order to be thereby rendered conductive upon detection of the phase advance of the load current $I_L$ by that circuit 10.

Figure 3:
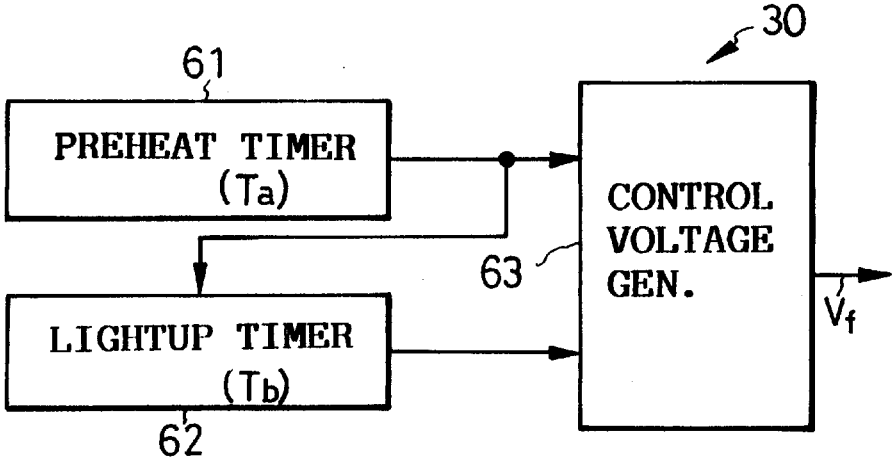
FIG. 3 is a block diagram showing in more detail the frequency control signal generator circuit included in the FIG. 2 inverter control circuit.

As drawn block diagrammatically in FIG. 3, the frequency control signal generator circuit 30 of the inverter control circuit 8 comprises a preheat timer 61, a lightup timer 62, and a control voltage generator circuit 63. Both timers 61 and 62 have their outputs connected to the control voltage generator circuit 63. The output of the preheat timer 61 is additionally connected to the lightup timer 62.

The preheat timer 61 responds to the closure of the power switch 3, FIG. 1, by putting out a preheat pulse signal indicative of the preheat period Ta from to to $t_0$ $t_1$ in FIG. 5, for delivery to the control voltage generator circuit 63. Capable of generating a variable control voltage Vf for inverter output frequency control, this circuit 63 puts out the control voltage $V_1$ of relatively high, constant magnitude when the pulse output from the preheat timer 61 indicates the preheat period Ta, as shown in the top half of FIG. 5.

Immediately upon lapse of the preheat period Ta the light up timer 62 puts out a lightup pulse signal representative of the lightup period Tb from $t_1$ to $t_4$ in FIG. 5. The control voltage generator circuit 63 responds to this input pulse by putting out the ramp voltage that decreases linearly in value from $V_1$ to $V_2$ during the lightup period Tb. The ramp voltage may be obtained by causing a capacitor, not shown, to discharge. After $t_4$ in FIG. 5, when the lamp 13 is to be kept glowing, the control voltage generator circuit 63 produces another, lower constant voltage $V_2$.

With reference back to FIG. 2 the control voltage Vf from the circuit 30 is impressed to the gate of the transistor 39 of the charging circuit 33. This transistor 39 is meant for use as variable resistor, impeding the flow of the base current of the transistor 40 in proportion to the control voltage Vf The resistance of the transistor 39 is high when the high control voltage $V_1$ is being impressed to its base during the preheat period Ta, correspondingly limiting the bypassing of the base current of the transistor 40 to the transistor 39. The collector current of the transistor 40 will therefore be of relatively great magnitude, and so will be that of the transistor 38, resulting in relatively rapid charging of the triangular wave capacitor 32. The gate-source voltage signals $V_{GS1}$ and $V_{GS2}$ for the on-off control of the inverter switches $Q_1$, and $Q_2$ will be correspondingly high in repetition frequency. Thus, as indicated in FIG. 5, the inverter output frequency f will be of the relatively high, constant value $f_1$, corresponding to the high control voltage $V_1$, during the preheat period Ta.

The triangular wave capacitor 32 will be charged at decreasing rates with the linear decrease in the magnitude of the control voltage Vf from $V_1$ to $V_2$ during the lightup period Tb as in the top half of FIG. 5. As the gate-source voltage signals $V_{GS1}$ and $V_{GS2}$ become correspondingly lower in repetition frequency, the inverter output frequency f will diminish from $f_1$ to $f_3$ as in the bottom half of FIG. 5.

It is self-evident from the foregoing that the inverter output frequency f will be of the low, constant value $f_3$ when the control voltage Vf is fixed at the low value $V_2$ after $t_4$ in FIG. 5.

Figure 4:
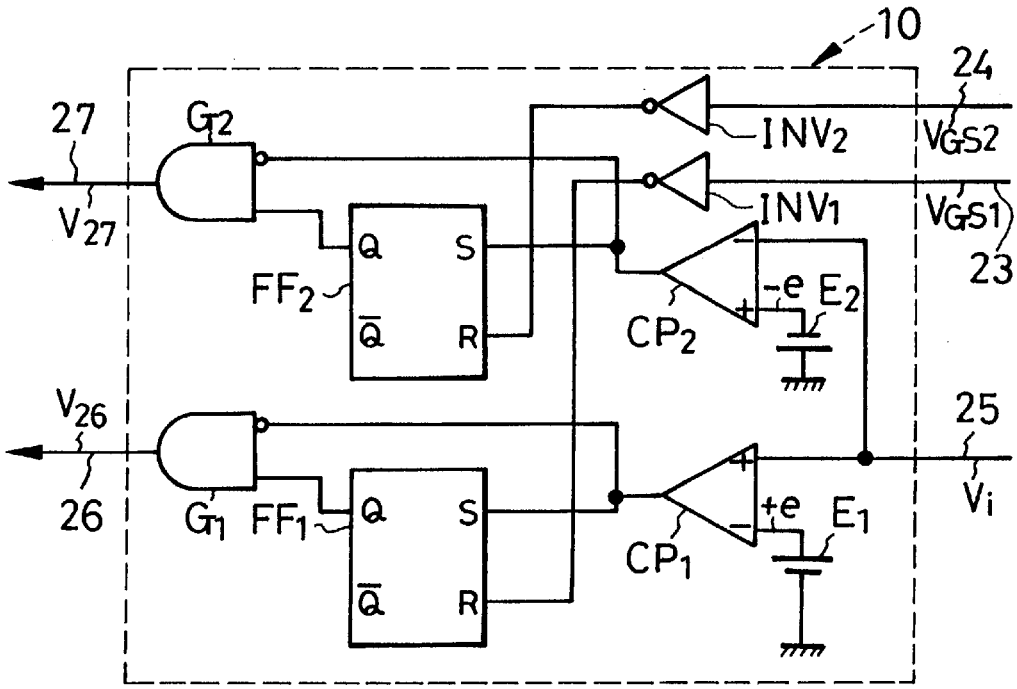
FIG. 4 is a schematic electrical diagram of the phase advance detector circuit of the FIG. 1 discharge lamp lighting system.
Figure 10:
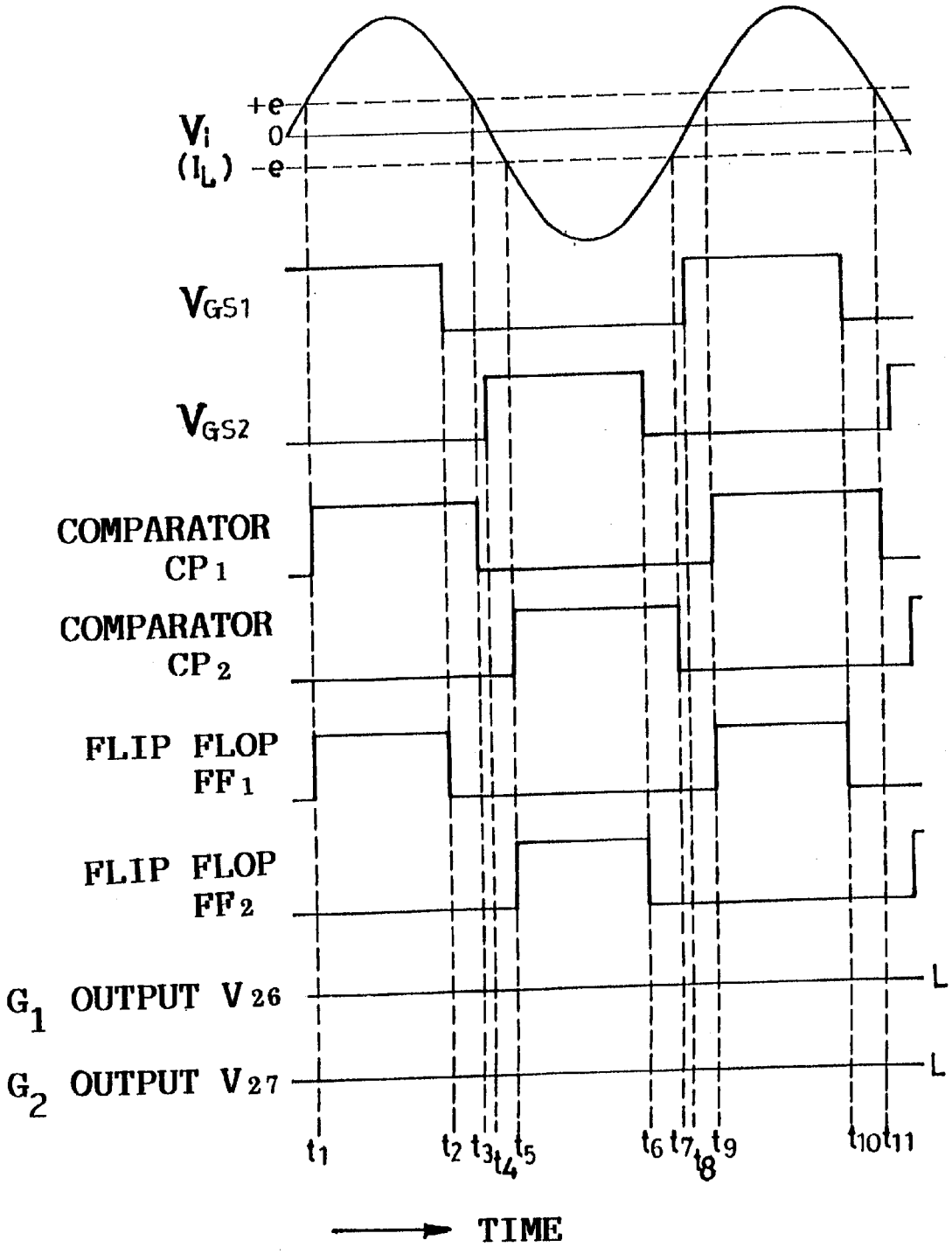
FIG. 10 is a diagram of waveforms that appear at various parts of the FIG. 4 phase advance detector circuit when the load current is in phase delay with respect to the inverter output voltage.
Figure 11:
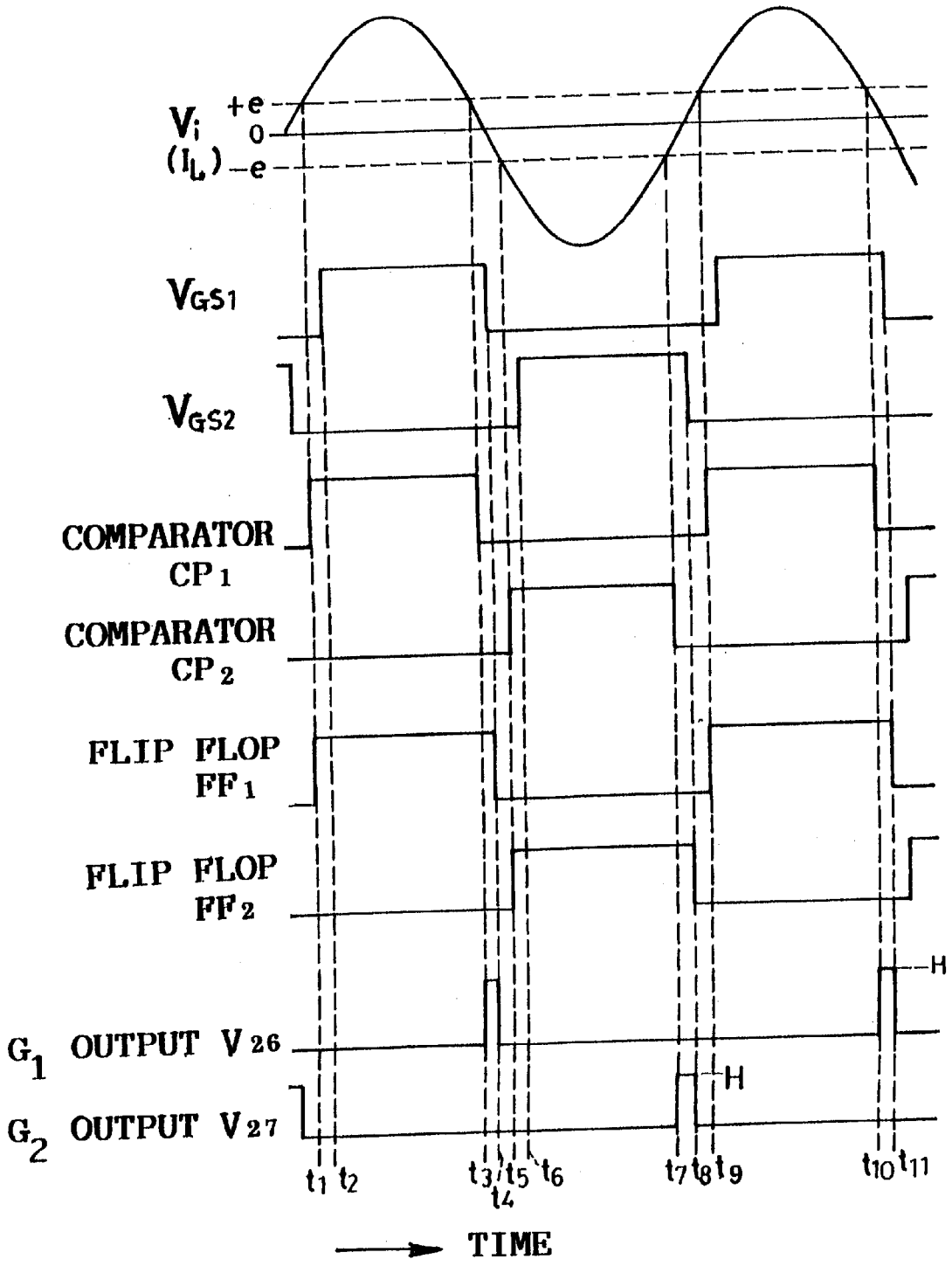
FIG. 11 is a diagram of waveforms that appear at various parts of the FIG. 4 phase advance detector circuit when the load current is in phase advance with respect to the inverter output voltage.

The phase advance detector circuit 10, shown in block form in FIG. 1, is illustrated in detail in FIG. 4. It comprises two comparators $CP_1$ and $CP_2$, two RS flip flops $FF_1$ and $FF_2$, two NOT circuits $INV_1$ and $INV_2$, and two logic circuits $G_1$ and $G_2$. The positive input of the first comparator $CP_1$ and the negative input of the second comparator $CP_2$ are both connected to the current detector 9, FIG. 1, via the conductor 25. The negative input of the first comparator $CP_1$ is connected to a first reference voltage source $E_1$, and the positive input of the second comparator $CP_2$ to a second reference voltage source $E_2$. The first reference voltage source $E_1$ provides a reference voltage +e that is higher than the mean value (e.g. zero) of the voltage Vi corresponding to the load current $I_L$, as indicated in FIGS. 10 and 11. The second reference voltage source $E_2$ provides another reference voltage −e that is lower than the mean value of the voltage Vi.

The first flip flop $FF_1$ has its set input S connected to the first comparator $CP_1$, and its reset input R to the first NOT circuit $INV_1$ and thence to the AND gate 57, FIG. 2, of the switch control signal forming circuit 29. The second flip flop $FF_2$ has its set input S connected to the second comparator $CP_2$, and its reset input R to the second NOT circuit $INV_2$ and thence to the AND gate 58, FIG. 2, of the switch control signal forming circuit 29.

The logic circuits $G_1$ and $G_2$ are both shown as inhibit AND gates. The first logic circuit $G_1$ has its inverting input connected to the first comparator $CP_1$, and its noninverting input to the noninverting output Q of the first flip flop $FF_1$. The second logic circuit $G_2$ has its inverting input connected to the second comparator $CP_2$, and its noninverting input to the noninverting output Q of the second flip flop $FF_2$. The outputs of the logic circuits $G_1$ and $G_2$ are connected respectively to the bases of the switching transistors 59 and 60, FIG. 2, of the overriding frequency control circuit 31.

Operation

Figure 8:
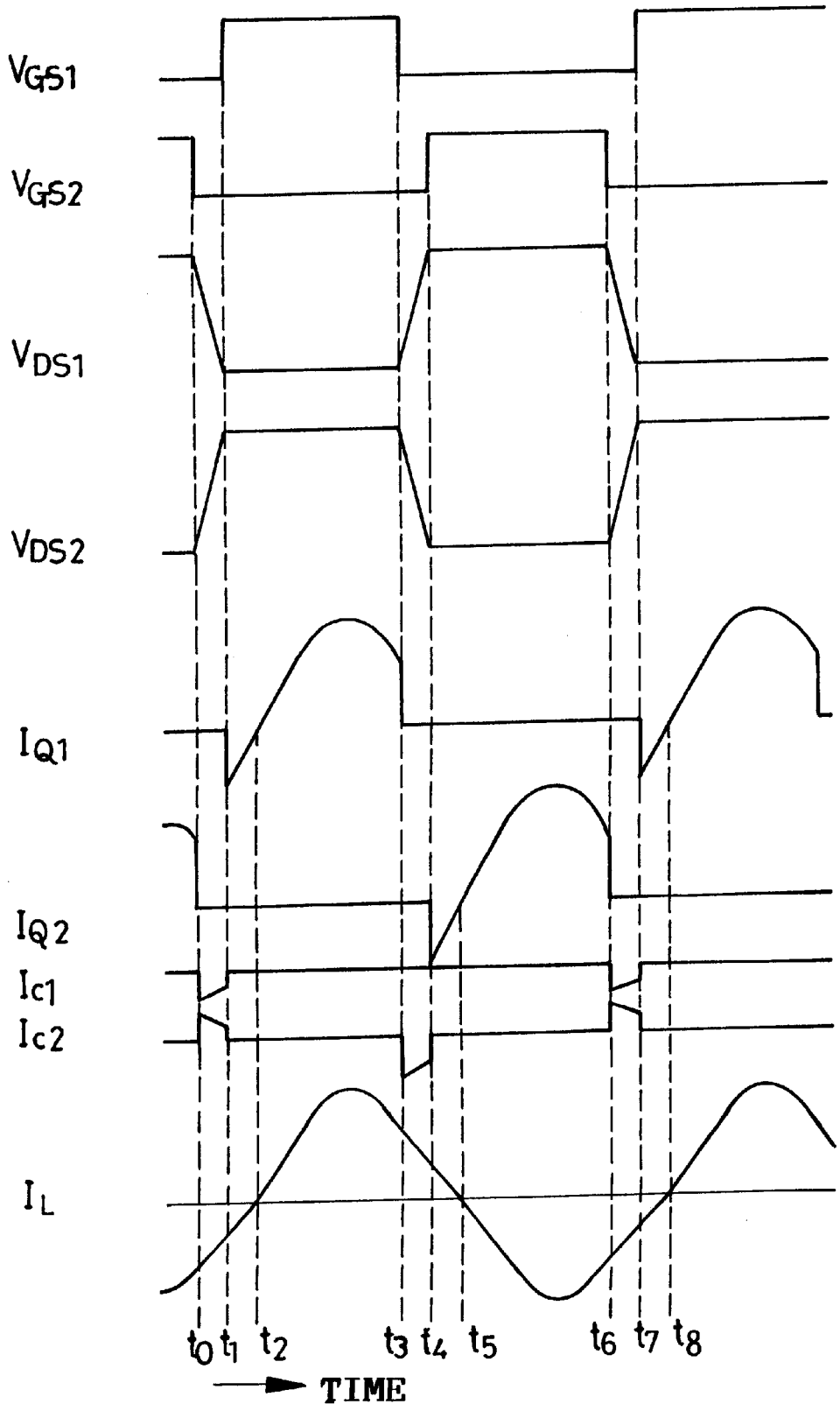
FIG. 8 is a diagram of waveforms that appear at various parts of the FIG. 1 discharge lamp lighting system when the load current is in phase delay with respect to the inverter output voltage.

FIG. 8 depict the waveforms of the voltages $V_{GS1}$, $V_{GS2}$, $V_{DS1}$ and $VDS_2$ and currents $I_{Q1}$, $I_{Q2}$, $I_{C1}$, $I_{C2}$ and $I_L$ appearing at correspondingly designated parts of the FIG. 1 lamp lighting system when the lamp 13 is glowing normally. From $t_0$ to $t_1$ in FIG. 8 is one of the noted dead times during which neither of the inverter switches $Q_1$ and $Q_2$ is actuated. Owing to the functioning of the capacitors $C_1$ and $C_2$ during the $t_0$–$t_1$ dead time the drain-source voltage $V_{DS1}$ of the first inverter switch $Q_1$ will become zero at $t_1$, when the gate-source voltage $V_{GS1}$ will be impressed to this first inverter switch. The current $I_{Q1}$ will then flow through the first inverter switch $Q_1$ as a circuit is completed which comprises the first d.c. supply terminal $\mathbf{4}_C$, first inverter switch $Q_1$, coupling capacitor 7, inductor 12, resonance capacitor 11, and second d.c. supply terminal 4*d*.

During the $t_1$–$t_2$ period in FIG. 8 a current corresponding to the final part of one negative half-cycle of the load current $I_L$ will flow through the diode section $D_1$ of the first inverter switch $Q_1$. Then, during the subsequent $t_2$–$t_3$ period, a positive-going current will flow through the switch section $S_1$ of the first switch $Q_1$. The waveforms of the first switch current $I_{Q1}$, and load current $I_L$ during the $t_1$–$t_3$ period will be sinusoidal, determined by the inductance of the inductor 12, the capacitance of the resonance capacitor 11, and the capacitance of the glowing lamp 13.

At $t_3$, when the gate-source voltage $V_{GS1}$ of the first inverter switch $Q_1$ becomes zero, the current $I_{Q1}$ that has been flowing through the first switch will start flowing through the closed circuit comprising the load circuit 6, the coupling capacitor 7, and the second capacitor $C_2$ connected in parallel with the second inverter switch $Q_2$. As the second capacitor $C_2$ is thus reversely charged with the current $I_{C2}$, the voltage across this second capacitor and therefore the drain-source voltage $V_{DS2}$ of the second inverter switch $Q_2$ will start dropping linearly at $t_3$ and become zero at $t_4$.

The drain-source voltage $V_{DS1}$ of the first inverter switch $Q_1$, on the other hand, will rise linearly from zero during the $t_3$–$t_4$ period, that voltage being the voltage between the pair of supply terminals 4*c* and 4*d* minus the drain-source voltage $V_{DS2}$ of the second inverter switch $Q_2$. A zero-volt switching will thus be achieved when the first switch $Q_1$, is turned off. The gate-source voltage $V_{GS2}$ of the second inverter switch $Q_2$ will go high at $t_4$ when the drain-source voltage $V_{DS2}$ of the second inverter switch $Q_2$ becomes zero, accomplishing a zero-volt switching when the second inverter switch is turned on.

The diode section $D_2$ of the second inverter switch $Q_2$ will become no longer reverse biased by the second capacitor $C_2$ at $t_4$ when the voltage across this second capacitor becomes zero. The load current $I_L$ will then start flowing to the diode section $D_2$, so that the current $I_{Q2}$ of the second inverter switch $Q_2$ flows reversely through its diode section $D_2$ from $t_4$ to $t_5$; that is, the current flows through the closed circuit of the load circuit 6 with the inductor 12, the second inverter switch diode section $D_2$, and the coupling capacitor 7 during this $t_4$–$t_5$ period.

The positive going current $I_2$ of the second inverter switch $Q_2$ during the subsequent $t_5$–$t_6$ period will flow through the circuit of the load circuit 6, coupling capacitor 7, and second inverter switch $Q_2$. This current $I_{Q2}$ flows through the load circuit 6 in a direction opposite to that of the current $I_{Q1}$ of the first inverter switch $Q_1$, during the $t_2$–$t_3$ period.

At $t_6$s, when the second inverter switch $Q_2$ goes off, the current $I_{Q2}$ that has been flowing through the second switch $Q_2$ will flow to both capacitors $C_1$ and $C_2$. With the flow of the currents $I_{C1}$ and $I_{C2}$ during the $t_6$–$t_7$ period, the voltage across the first capacitor $C_1$ will drop linearly as it is charged reversely, and so will the drain-source voltage $V_{DS1}$ of the first inverter switch $Q_1$. The voltage across the second capacitor $C_2$ and the drain-source voltage $V_{DS2}$ of the second inverter switch $Q_2$ will rise linearly. Thus are accomplished zero-volt switchings when the second inverter switch $Q_2$ is turned off and when the first inverter switch $Q_1$ is turned on.

As has been set forth with reference to FIG. 5, the output frequency f of the inverter circuit 5 is varied from $f_1$ to $f_3$, FIG. 6, during the lightup period Tb in the course of which the lamp 13 is to start glowing, as at $t_2$ in FIG. 5. The resulting operation of the FIG. 1 lamp lighting system will be similar to what has been hereinbefore explained in connection with FIG. 8, only if the load circuit 6 is an inductive reactance.

Figure 9:
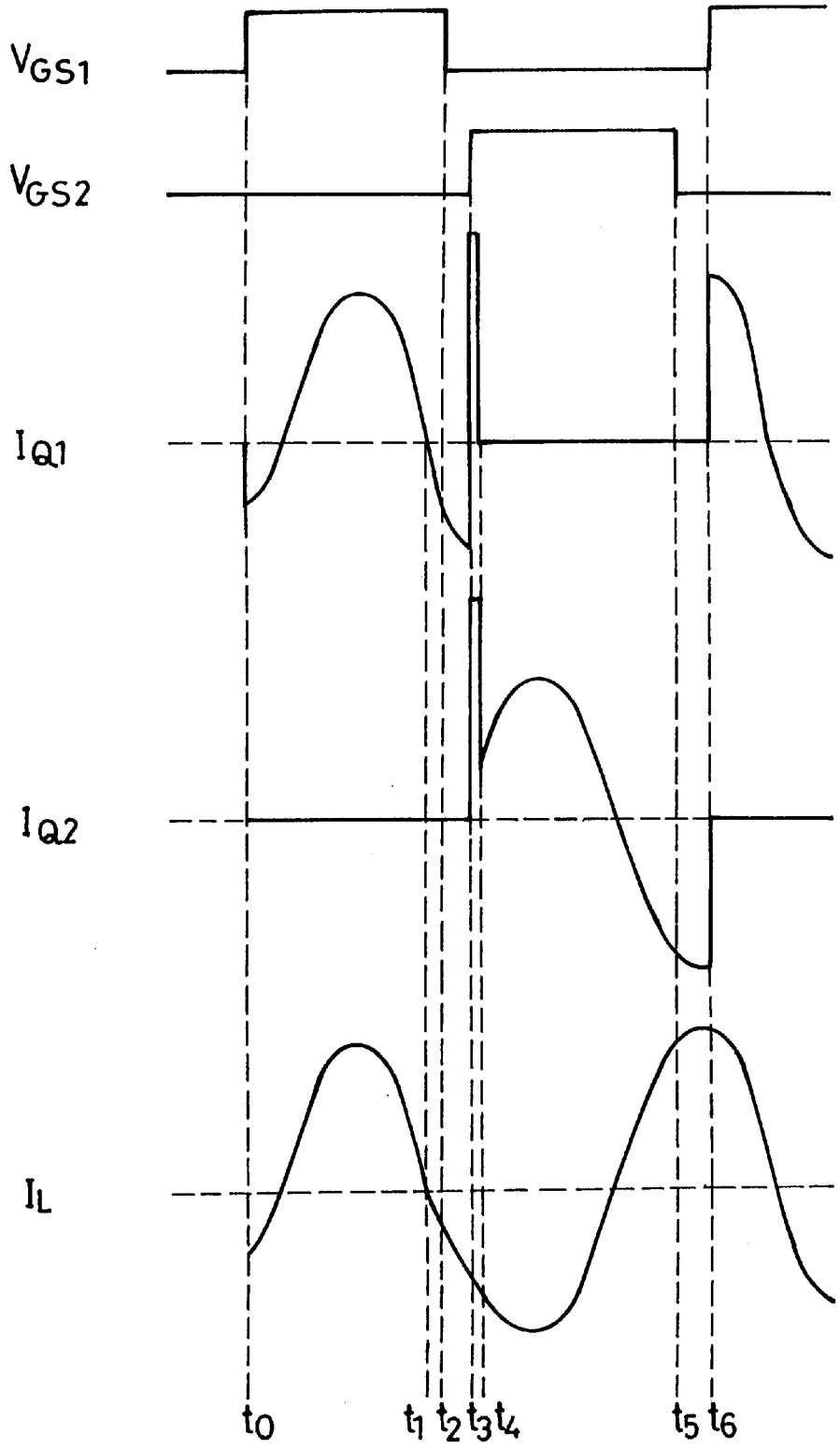
FIG. 9 is a diagram of waveforms that appear at various parts of the FIG. 1 discharge lamp lighting system when the load current is in phase advance with respect to the inverter output voltage.

It will also be recalled in association with FIG. 6 that the load circuit 6 becomes a capacitive reactance if the lamp 13 accidentally goes off and if, as has been the case heretofore, the inverter output frequency f was left as at $f_3$, less than the resonance frequency $f_0$ of the curve A. Then, as indicated in FIG. 9, the currents $I_{Q1}$ and $I_{Q2}$ of the inverter switches $Q_1$ and $Q_2$ and the load current $I_L$ will all be in phase advance with respect to the gate-source voltages $V_{GS1}$ and $V_{GS2}$ as well as to the resulting inverter output voltage. The current waveforms $I_{Q1}$, $I_{Q2}$ and $I_L$ are depicted in this diagram so that they become increasingly more phase advanced with time.

During the $t_0$–$t_1$ period in FIG. 9, being in phase advance, both first inverter switch current $I_{Q1}$ and load current $I_L$ are shown to cross zero at $t_1$ which precedes $t_2$ when the first gate-source voltage $V_{GS1}$ goes low. The negative-going first inverter switch current $I_{Q1}$ and load current $I_L$ from $t_1$ to $t_3$ will flow through the circuit comprising the load circuit 6, coupling capacitor 7, and the diode section $D_1$ of the first inverter switch $Q_1$. The second inverter switch $Q_2$ will turn on at $t_3$ when its gate-source voltage $V_{GS2}$ goes high. The load current $I_L$ will now flow to the second inverter switch $Q_2$. At the same time the carriers that have been stored on the first inverter switch diode section $D_1$ will be released, and the current due to this carrier release will flow into the second inverter switch $Q_2$. The pair of outputs 4*c* and 4*d* of the rectifying and smoothing circuit 4 are short-circuited by the first inverter switch diode section $D_1$ and the second inverter switch $Q_2$ from $t_3$ to $t_4$, so that the currents $I_{Q1}$ and $I_{Q2}$ will be of greater magnitude than the peak value of the current $I_{Q1}$ from $t_0$ to $t_1$.

Should the load circuit 6 be left in phase advance, overcurrent would flow each time the second inverter switch $Q_2$ is turned on, possibly resulting in the destruction of either or both of the inverter switches $Q_1$ and $Q_2$. The present invention precludes this danger by making the inverter output frequency higher than the resonance frequency $f_0$ on the FIG. 6 curve A upon detection of the phase advance of the load current by the phase advance detector circuit 10, FIG. 4. Overcurrent protection is accomplished as the load circuit 6 is turned into an inductive reactance in this manner.

How the phase advance detector circuit 10 detects the phase advance will be best understood by studying the waveforms of FIGS. 10 and 11. FIG. 10 shows the waveforms appearing at various parts of the FIG. 4 phase advance detector circuit 10 when the load circuit 6 is inductive reactance, with the load current $I_L$ in phase delay with respect to the inverter output voltage and the inverter switch gate-source voltages $V_{GS1}$ and $V_{GS2}$. FIG. 11 shows the waveforms appearing at the same parts of the phase advance detector circuit 10 when the load circuit 6 is accidentally turned into capacitive reactance, with the load current $I_L$ consequently in phase advance with respect to the inverter output voltage and the inverter switch gate-source voltages. The output voltage Vi of the current detector 9, corresponding to the load current $I_L$ flowing through the load circuit 6, is shown as a sinusoidal wave in both FIGS. 10 and 11 for ease of explanation.

Directed over the line 25 into the comparators $CP_1$ and $CP_2$, FIG. 4, of the phase advance detector circuit 10, the output voltage Vi of the current detector 9 will be compared with the two reference voltages +e and −e indicated by the dashed lines in both FIGS. 10 and 11. These reference voltages have positive and negative values, respectively, that are so close to zero that the comparators $CP_1$ and $CP_2$ will put out pulses having durations only somewhat less than 180 electrical degrees of the current detector output voltage Vi.

Thus, in both FIGS. 10 and 11, the intervals $t_3$–$t_5$, $t_7$–$t_9$ and so forth between the output pulses of the two comparators $CP_1$ and $CP_2$ (i.e. the periods during which pulses are produced by neither of these comparators) represent those fractions of the current detector output voltage Vi which are close to zero, not more in value than the first reference voltage +e and not less in value than the second reference voltage −e. According to the present invention, and in this embodiment, whether the control pulses of the inverter switches $Q_1$ and $Q_2$ (i.e. the gate-source voltages $V_{GS1}$ and $V_{GS2}$ are properly controlling them or not is determined from whether the trailing edges of the control pulses are located within the pulse intervals $t_3$–$t_5$, $t_7$–$t_9$ and so forth.

For that determination the output pulses of the comparators $CP_1$ and $CP_2$ are directed to the set inputs S of the flip flops $FF_1$ and $FF_2$, respectively, to the reset inputs R of which are directed the inversions of the gate-source voltages $V_{GS1}$ and $V_{GS2}$. The resulting pulse outputs from the flip flops $FF_1$ and $FF_2$ are as shown also in FIGS. 10 and 11. It will be observed from FIG. 10 that the flip flop output pulses are less in duration than the output pulses of the comparators $CP_1$ and $CP_2$ during the normal operation of the lamp lighting system, thereby keeping low the outputs $V_{26}$ and $V_{27}$ from the inhibit AND gates $G_1$ and $G_2$.

In event the lamp has accidentally gone off, on the other hand, the output pulses of the flip flop $FF_1$ and $FF_2$ will grow longer in duration than the output pulses of the comparators $CP_1$ and $CP_2$, as in FIG. 11. There will therefore be periods, as from $t_3$ to $t_4$, from $t_7$ to $t_8$, and from $t_{10}$to $t_{11}$, during which the comparators $CP_1$ and $CP_2$ are low whereas the flip flops $FF_1$ and $FF_2$ are high. The logic circuits $G_1$ and $G_2$ will then produce short duration pulses, indicating that the load current $I_L$ is in phase advance or phase lead.

The short duration pulses $V_{26}$ and $V_{27}$ from the phase advance detector circuit 10 will be impressed to the bases of the switching transistors 59 and 60, FIG. 2, of the overriding frequency control circuit 31. Thereupon the repetition rates of the gate-source voltages $V_{GS1}$ and $V_{GS2}$ will become higher, as has been set forth in connection with the waveforms after the moment $t_6$ in FIG. 12, making the resulting inverter output frequency f higher than the resonance frequency $f_0$ of the curve A in FIG. 6. For example, the resulting inverter output frequency is $f_2$ between $f_0$ and $f_1$.

If the lamp remains unlit, the load current $I_L$ will again advance in phase. Thereupon the foregoing cycle of operation will be repeated to delay the phase of the load current. Such alternate advances and delays in the phase of the load current is far preferable to the conventional practice of leaving the current advanced in phase from the viewpoint of overcurrent protection of the inverter switches $Q_1$ and $Q_2$. Experiment has proved that, protected against overcurrent according to the instant invention, these switches become drastically less heated than if the load current is left advanced in phase according to the prior art.

The automatic return of the inverter output frequency to the normal value $f_3$, FIG. 6, after the phase advance of the load current has been corrected is preferred because the lamp, after once going off for some reason or other, may in all likelihood resume glowing. The useful life of the lamp can thus be extended to the maximum possible degree.

It will also be appreciated that the inverter output frequency f is reduced from $f_1$ to $f_3$, FIGS. 5 and 6, past the resonance frequency $f_0$ even if the lamp fails to light up at the prescribed frequency $f_2$. Even then the lamp may start an electric discharge as the inverter output frequency draws nearer the resonance frequency $f_0$. This feature will prove to be an advantage since the lamp lighting system according to the invention must be expected to be put to use with discharge lamps of greatly different lightup characteristics.

Second Form

Figure 13:
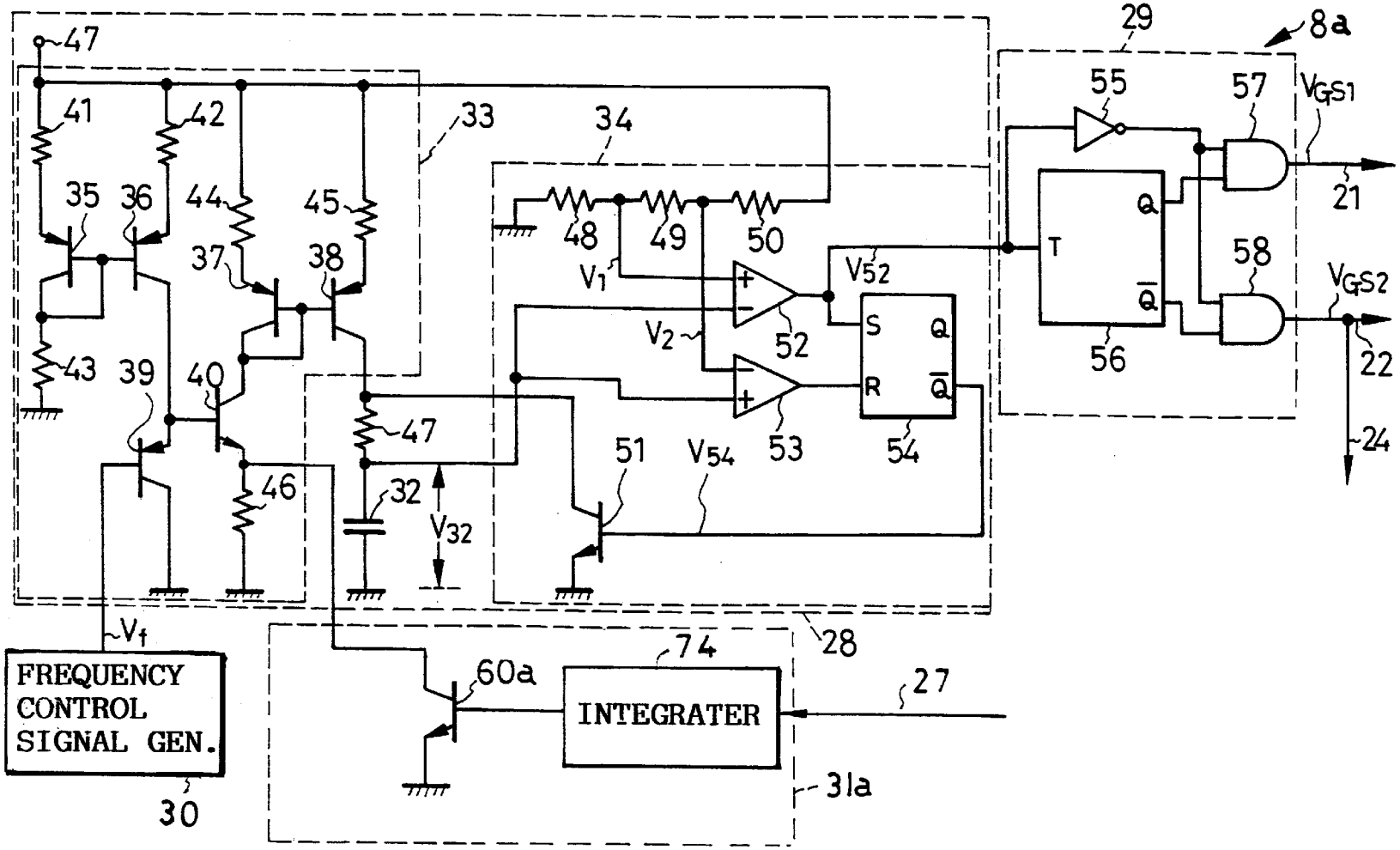
FIG. 13 is a schematic electrical diagram, partly in block form, of a modified inverter control circuit forming a part of another preferred form of discharge lamp lighting system according to the present invention.
Figure 14:
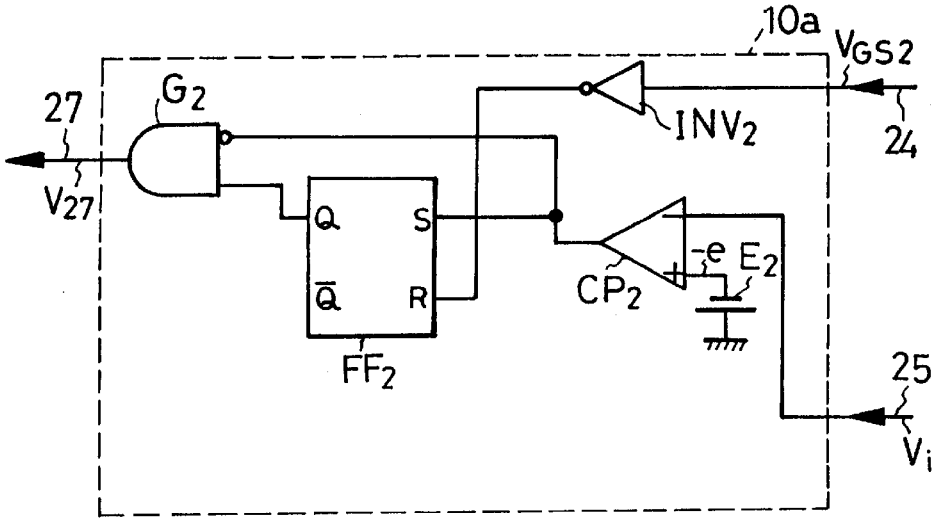
FIG. 14 is a schematic electrical diagram of a modified phase advance detector circuit for use with the FIG. 13 inverter control circuit.

The second preferred form of discharge lamp lighting system according to the invention features a modified inverter control circuit 8*a*, FIG. 13, and a modified phase advance detector circuit 10*a*, FIG. 14. These modified circuits 8*a* and 10*a* are intended for use in the FIG. 1 lighting system in substitution for their first disclosed counterparts 8 and 10. Only these modified circuits will therefore be described in detail, it being understood that the other parts of the second system are as set forth above in conjunction with FIGS. 1–12.

The modified inverter control circuit 8*a* of FIG. 13 differs from the FIG. 2 inverter control circuit 8 only in the construction of the overriding frequency control circuit 31*a*. This circuit 31*a* comprises a variable resistor in the form of a transistor 60*a* and an integrating circuit 74. Unlike the switching transistor 60, FIG. 2, of the preceding embodiment, which is connected in parallel with the capacitor 32, the transistor 60*a* is connected in parallel with the resistor 46 of the charging circuit 33 of the pulse generator circuit 28. The integrating circuit 74 has its input connected to the single output conductor 27 of the modified phase advance detector circuit 10*a*, FIG. 14, for smoothing the output $V_{27}$ therefrom preparatory to delivery to the base of the transistor 60*a*.

A comparison of FIG. 14 with FIG. 4 will reveal that the modified phase advance detector circuit 10*a* is similar to the original circuit 10 except for the absence of the first comparator $CP_1$, first reference voltage source $E_1$, first flip flop $FF_1$, first logic circuit $G_1$, and first inverter $INV_1$ from the former. The comparator $CP_2$, reference voltage source $E_2$, flip flop $FF_2$, logic circuit $G_2$, and inverter $INV_2$ are left in the circuit 10*a*, with the input of the inverter $INV_2$ connected to the output line 24 of the inverter control circuit 8, and the negative input of the comparator $CP_2$ connected to the current detector output line 25. The inverter $INV_2$ could, however, be connected to the inverter control circuit output line 25 for inputting the gate-source voltage $V_{GS1}$ of the first inverter switch $Q_1$ instead of the gate-source voltage $V_{GS2}$ of the second inverter switch $Q_2$.

The modified phase advance detector circuit 10*a* will operate just like the FIG. 4 circuit 10, producing a low output as long as the load current is in phase delay. Upon phase advancement of the load current, on the other hand, the phase advance detector circuit 10*a* will put out pulses similar to those shown in FIG. 11 for the FIG. 4 circuit 10. The overriding frequency control circuit 31*a* will operate, upon receipt of a prescribed number, inclusive of one, of pulses from the phase advance detector circuit 10*a* within a preset length of time, to cause an increase in the current charging the triangular wave capacitor 32 of the pulse generator circuit 28 so as to make the inverter output frequency f higher than the resonance frequency $f_0$ on the curve A in FIG. 6. Thus the second embodiment of the invention accomplishes the same purposes as the first disclosed embodiment.

Third Form

Figure 15:
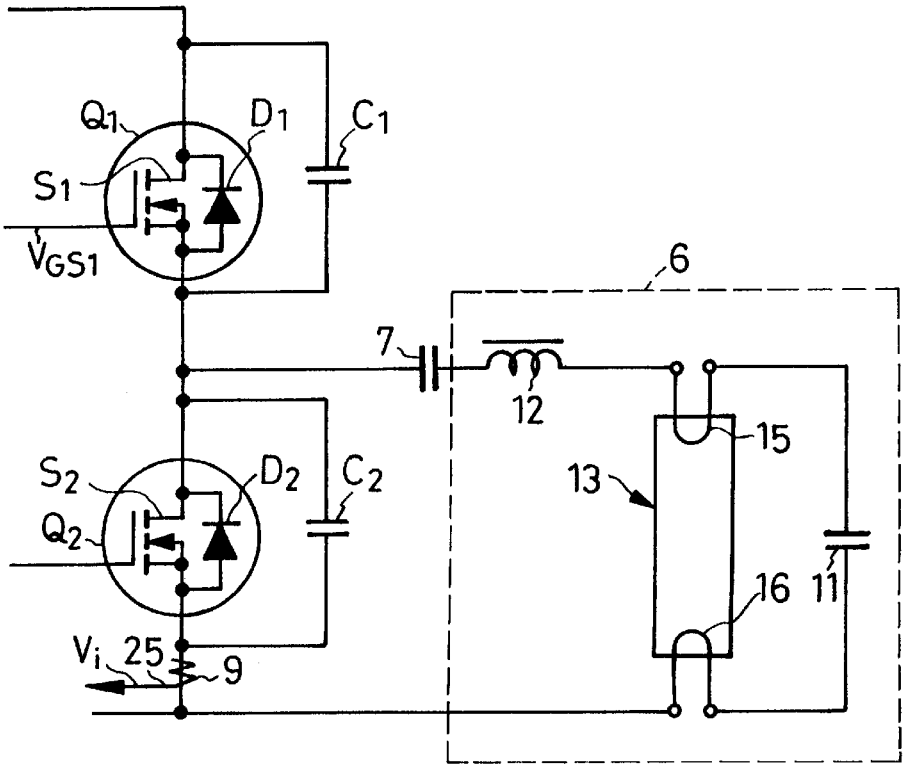
FIG. 15 is a partial schematic electrical diagram of a third preferred form of discharge lamp lighting system according to this invention.
Figure 16:
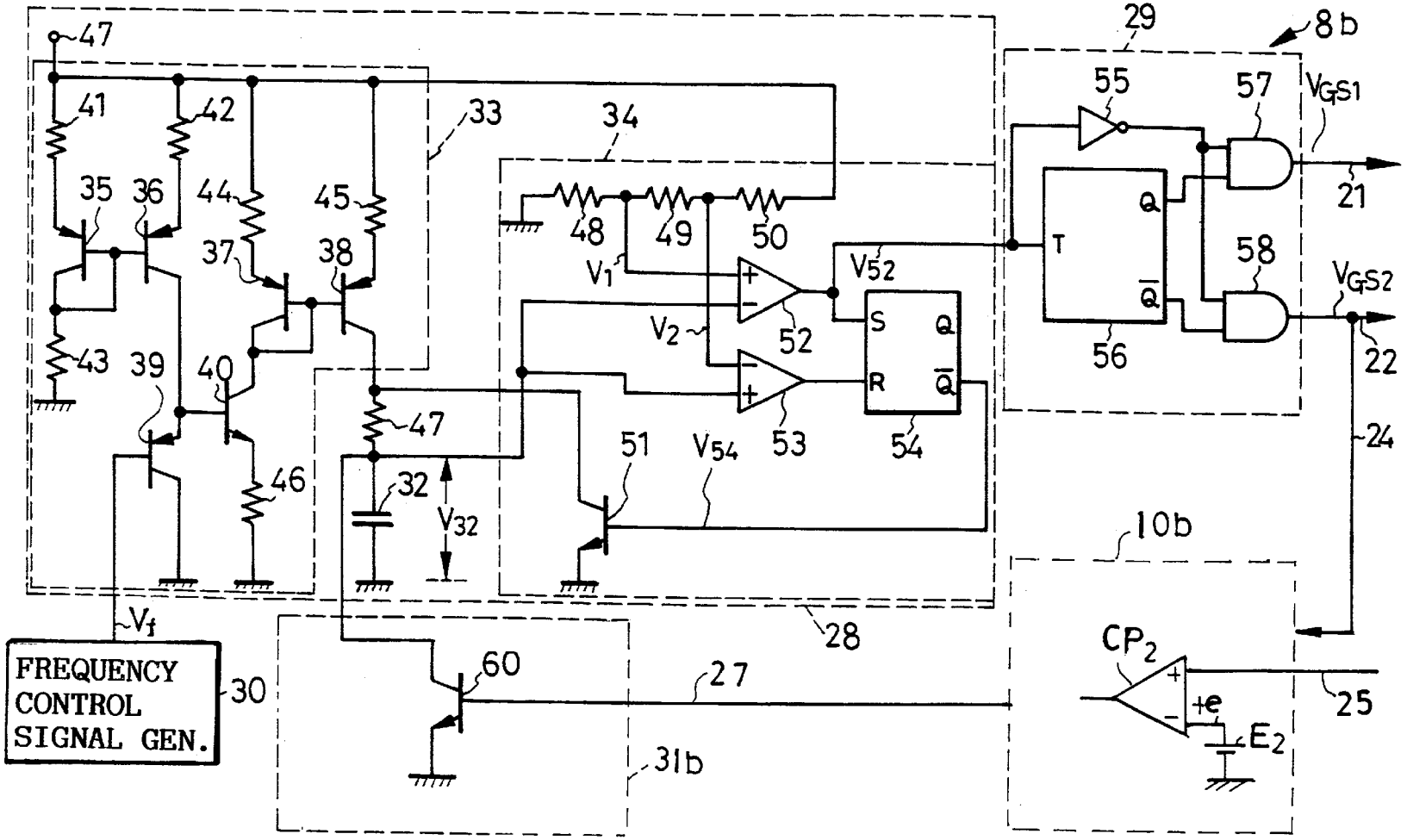
FIG. 16 is a schematic electrical diagram of a modified inverter control circuit and a modified phase advance detector circuit forming parts of the third preferred form of discharge lamp lighting system.

In still another preferred form of lamp lighting system according to the invention, the current detector 9 is rearranged as in FIG. 15 for detecting phase advancement from the current of the second inverter switch $Q_2$, and a modified phase advance detector circuit is provided as at 10*b* in FIG. 16 for half-wave phase detection like the FIG. 14 circuit 10*a* The inverter control circuit is also modified correspondingly, as illustrated in FIG. 16 and therein generally labeled 8*b*. This third embodiment of the invention is similar to the first embodiment in the other details of construction.

The FIG. 15 current detector 9 detects the current $I_{Q2}$ of the second inverter switch $Q_2$, that current being shown in both FIGS. 8 and 9 in conjunction with the first disclosed embodiment. The current detector output signal Vi is sent over the line 25 to the phase advance detector circuit 10*b*.

The phase advance detector circuit 10*b* is shown greatly simplified in FIG. 16 because it is identical in construction with the FIG. 14 phase advance detector circuit 10*a* except for the inputs of the comparator $CP_2$. As indicated in FIG. 16, the comparator $CP_2$ has a positive input connected to the current detector 9 by way of the line 25, and a negative input connected to the reference voltage source $E_2$ for inputting a positive, instead of negative, reference voltage +e.

The modified inverter control circuit 8*b*, FIG. 16, features an overriding frequency control circuit 31*b* having but one switching transistor 60. Connected in parallel with the triangular wave generating capacitor 32, as is the transistor 60 of the FIG. 2 circuit 31, the transistor 60 has its base connected directly to the output line 27 of the phase advance detector circuit 10*b*.

Such being the construction of the third preferred form of lamp lighting system according to the invention, it operates substantially like the first form and gains substantially the same advantages therewith. The only operational difference is that the phase advancement is corrected only half as often as in the first embodiment.

Fourth Form

Figure 17:
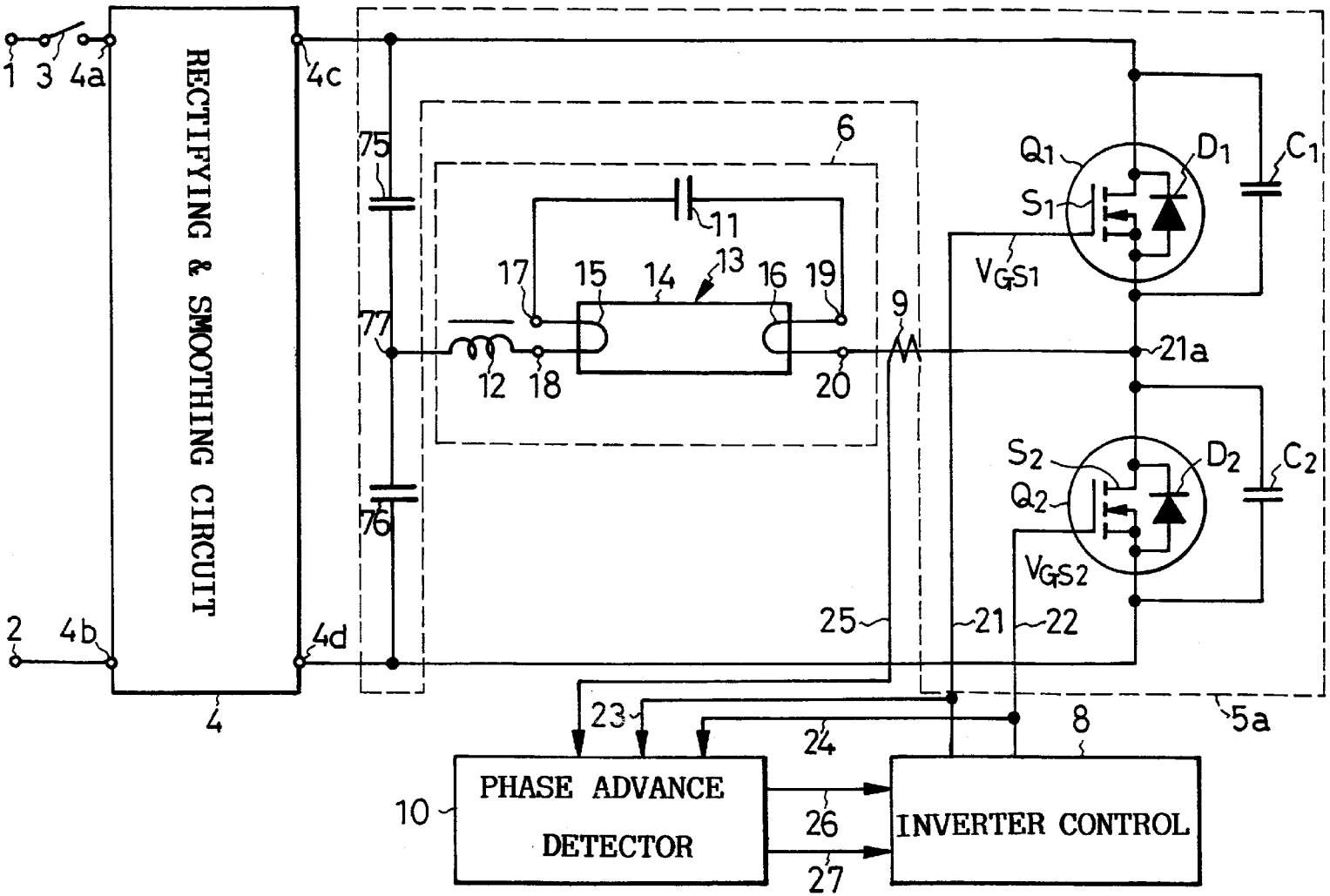
FIG. 17 is a schematic electrical diagram of a fourth preferred form of discharge lamp lighting system according to this invention.

FIG. 17 shows the fourth preferred form of lamp lighting system according to this invention, which is similar in construction to the first form except for having a half-bridge inverter circuit 5*a* of itself known construction in place of the FIG. 1 inverter circuit 5. The inverter circuit 5*a* has a serial circuit of two voltage-dividing capacitors 75 and 76 connected in parallel with the serial circuit of two inverter switches $Q_1$ and $Q_2$. The load circuit 6 is connected between the junction 21*a* between the inverter switches $Q_1$ and $Q_2$ and the junction 77 between the voltage-dividing capacitors 75 and 76. The load circuit 6 is of the same construction as those of the foregoing embodiments, comprising the fluorescent lamp 13 and the resonance capacitor 11 and inductor 12.

No operational description is considered necessary because the half-wave inverter circuit 5*a*, the sole feature of this embodiment, is of conventional design and itself operates just like the FIG. 1 inverter circuit 5.

Fifth Form

Figure 18:
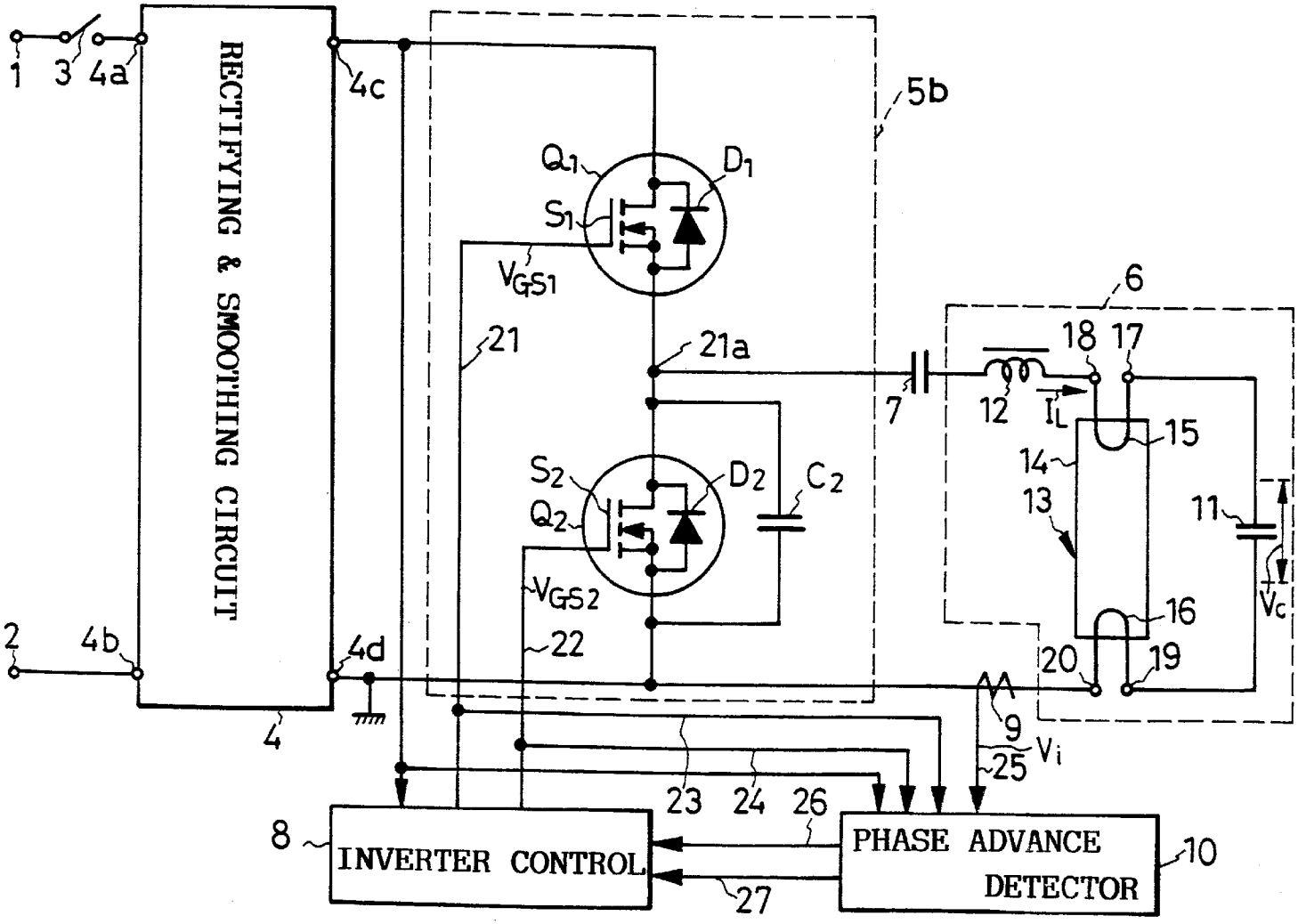
FIG. 18 is a schematic electrical diagram of a fifth preferred form of discharge lamp lighting system according to this invention.

The inverter circuit 5 of the first embodiment of the invention may be further modified as shown at 5*b* in FIG. 18. The modified inverter circuit 5*a* differs from the FIG. 1 inverter circuit 5 only in that the former does not have the first capacitor $C_1$. Incorporating this inverter circuit 5*a*, the lamp lighting system needs no alteration of construction.

When the first switch $Q_1$ of the modified inverter circuit 5*a* is turned off, both the voltage across the remaining capacitor $C_2$ and the drain-source voltage $V_{DS2}$ of the second inverter switch $Q_2$ will drop gradually. The drain-source voltage $V_{DS1}$ of the first inverter switch $Q_1$ does not rise suddenly, being equal to the supply voltage minus the voltage across the capacitor $C_2$. Zero-volt switching can thus be realized when the first inverter switch $Q_2$ is turned off.

The possible phase advancement of the load current in this fifth embodiment is contained in the same manner as in the first.

Sixth Form

Figure 19:
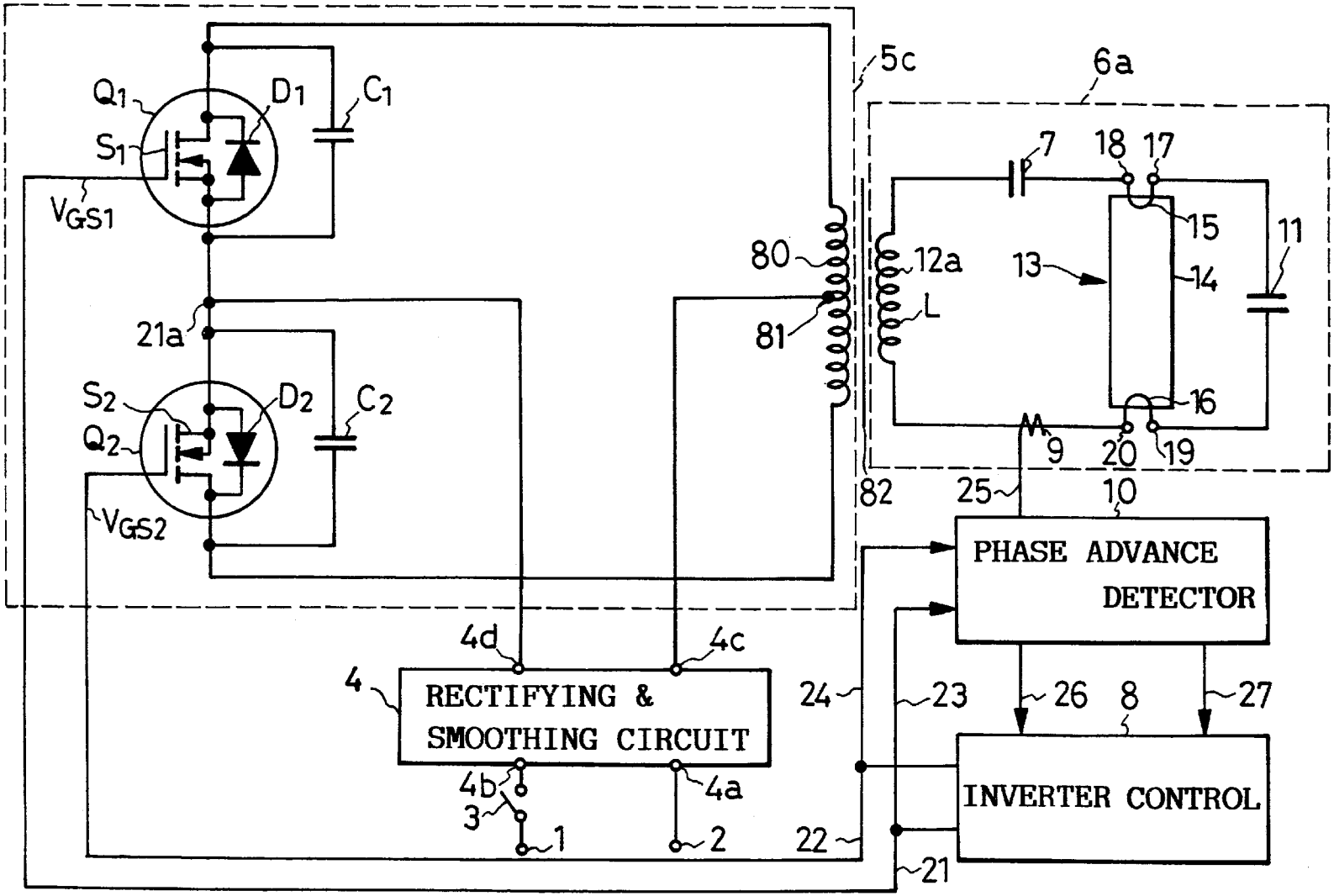
FIG. 19 is a schematic electrical diagram of a sixth preferred form of discharge lamp lighting system according to this invention.

The sixth preferred form of lamp lighting system shown in FIG. 19 includes still another modified inverter circuit 5*c* in combination with a correspondingly modified load circuit 6*a*, the other details of construction being similar to those of the first preferred form.

The inverter circuit 5*c* has a transformer primary winding 80 having a center tap 81 connected to the d.c. output terminal 4*c* of the rectifying and smoothing circuit 4. Between the opposite extremities of the transformer primary

80 and the other d.c. output terminal 4*d* of the circuit 4 are connected respectively the parallel circuits of the inverter switches $Q_1$ and $Q_2$ and the capacitors $C_1$ and $C_2$. The inverter switches $Q_1$ and $Q_2$ are so oriented as to cause current flow toward the junction 21*a* therebetween; in other words, the inverter switches are connected in parallel with each other via the transformer primary 80.

Electromagnetically coupled to the transformer primary 80 via a core 82, a transformer secondary 12*a* is shown included in the load circuit 6*a* for use as resonance inductor having inductance L. It is understood that the core 82 is so formed as to provide leakage flux. The transformer secondary or inductor 12*a* has one extremity connected to the lamp terminal 18 via a coupling capacitor 7, and another extremity connected to the lamp terminal 20. Connected between the other two lamp terminals 17 and 19, the capacitor 11 coacts with the inductor 12*a* to form a serial LC resonance circuit.

This system operates just like the FIG. 1 system to restrict the phase advancement of the load current. In the inverter circuit 5*c* of the FIG. 19 construction, the transformer core 82 may be magnetically saturated if, because of phase advancement of the load current, the first inverter switch $Q_1$, for instance, is turned on when a current is flowing through the diode section $D_2$ of the second inverter switch $Q_2$. The inverter switches $Q_1$ and $Q_2$ can be protected from the resulting overcurrent as the phase advancement is contained according to the invention.

Seventh Form

Figure 20:
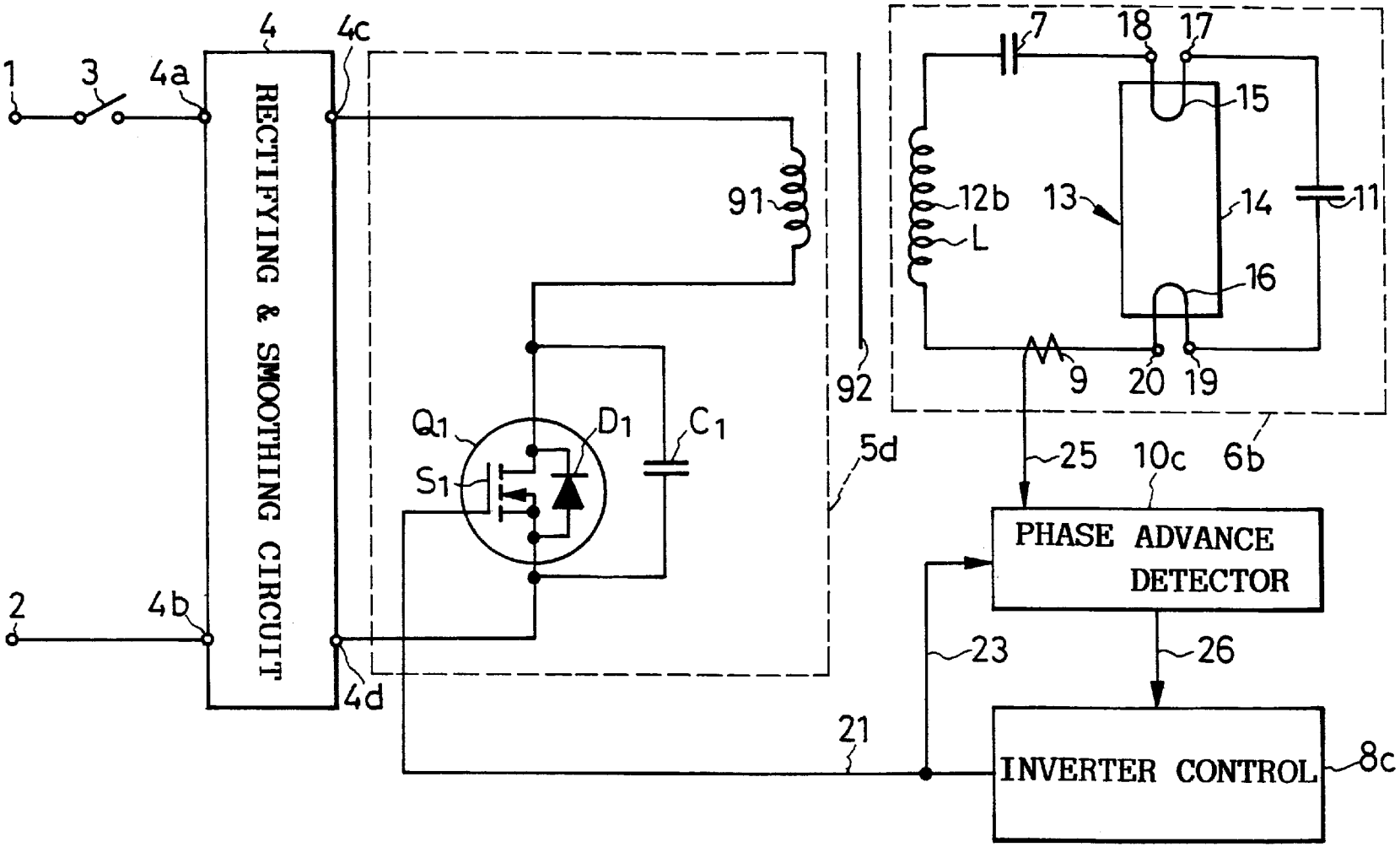
FIG. 20 is a schematic electrical diagram of a seventh preferred form of discharge lamp lighting system according to this invention.

FIG. 20 shows the seventh preferred form of lamp lighting system according to the invention, which differs from the FIG. 1 system in the constructions of an inverter circuit 5*d*, load circuit 6*b*, inverter control circuit 8*c*, and phase advance detector circuit 10*c*.

The inverter circuit 5*d* is of known make having but one switch $Q_1$ connected in series with a transformer primary 91 between the pair of d.c. supply terminals 4*c* and 4*d*. Similar in construction to the FIG. 19 load circuit 6*a*, the load circuit 6*b* has a transformer secondary 12*b* electromagnetically coupled to the transformer primary 91 via a core 92 having leakage flux.

The phase advance detector circuit 10*c* is similar to the FIG. 14 circuit 10*a* in dealing with only the half wave of the load current.

Although not shown in detail, the inverter control circuit 8*c* is understood to be similar in construction to the FIG. 2 counterpart 8 except for the provision of a monostable multivibrator in place of the switch control signal forming circuit 29, and for the absence of the switching transistor 60 of the overriding frequency control circuit 31. The monostable multivibrator produce pulses for actuating the single switch $Q_1$ of the FIG. 20 inverter circuit 5*d* in response to the output pulses of the comparator 52, FIG. 2. The single switching transistor, designated 59 in FIG. 2, of the FIG. 20 inverter control circuit 8*c* causes the triangular wave generating capacitor, designated 32 in FIG. 2, to discharge in response to the output from the phase advance detector circuit 10*c*.

Thus, except for the inverter circuit 5*d*, the FIG. 20 system is essentially alike in construction and operation to the FIG. 1 system. As an additional operational advantage, however, the phase advance cancellation system according to the invention serves to limit current surges that may occur when the single inverter switch $Q_1$ is turned on and off while the load circuit 6*b* is a capacitive reactance.

Although the present invention has been hereinbefore described in terms of highly specific embodiments thereof, it is not desired that the invention be limited by the exact details of such disclosure. A variety of modifications and alterations of the illustrated embodiments may be resorted to without departing from the scope of this invention. For example, an FET of the known kind having a terminal for current detection may be employed as the second inverter switch, thereby essentially incorporating the current detector 9 with the second inverter switch.

What is claimed is:

1. A lighting system for a discharge lamp, providing for overcurrent protection of an inverter switch or switches, the lighting system comprising:

(a) an inverter circuit for providing a variable frequency output voltage;

(b) a load circuit connected to the inverter circuit and including a resonant circuit having a capacitor with which a discharge lamp is to be connected in parallel, in order to cause an inversely frequency dependent voltage to be applied between a pair of electrodes of the lamp according to a predefined resonance characteristic, the resonant circuit having a resonance frequency ($f_0$) that is less than a discharge start frequency ($f_2$) at which the lamp is to start glowing;

(c) inverter control means connected to the inverter circuit for lighting up the lamp by changing the frequency of the output voltage of the inverter circuit from a first frequency ($f_1$) which is higher than the discharge start frequency ($f_2$) to a second frequency ($f_3$) which is less than the resonance frequency ($f_0$) of the resonant circuit, and for holding the lamp glowing by maintaining the output voltage of the inverter circuit at the second frequency;

(d) phase advance detector means for ascertaining whether or not a current flowing through the load circuit is in phase advance with respect to the output voltage of the inverter circuit; and (e) overriding frequency control means connected between the phase advance detector means and the inverter control means for causing the inverter control means to make the frequency of the output voltage of the inverter circuit higher than the resonance frequency ($f_0$) of the resonant circuit when the current flowing through the load circuit is ascertained to be in phase advance with respect to the output voltage of the inverter circuit;

(f) whereby, when found to be in phase advance with respect to the inverter output voltage, the load current is automatically delayed in phase in order to protect a switch or switches included in the inverter circuit from destruction due to overcurrent.

2. The discharge lamp lighting system of claim 1 wherein the inverter circuit includes a pair of inverter switches to be alternately turned on and off for providing the variable frequency output voltage, and wherein the inverter control means comprises:

(a) a frequency control signal generator circuit for providing a frequency control signal;

(b) a variable frequency pulse generator circuit connected to the frequency control signal generator circuit for providing a series of pulses at a repetition rate dictated by the frequency control signal; and (c) a switch control signal forming circuit connected between the variable frequency pulse generator circuit and the inverter circuit for providing switch control signals thereby to turn the pair of inverter switches alternately on and off at rates determined by the output pulses of the pulse generator circuit.

3. The discharge lamp lighting system of claim 2 wherein the overriding frequency control means comprises an overriding frequency control circuit connected to the variable frequency pulse generator circuit of the inverter control means for compulsorily modifying the repetition rate of the output pulses thereof in the event of phase advancement of the load current.

4. The discharge lamp lighting system of claim 2 wherein the variable frequency pulse generator circuit of the inverter control means comprises:

(a) a capactor for providing a triangular wave voltage;

(b) a charging circuit for charging the capacitor of the pulse generator circuit;

(c) discharging means for discharging the capacitor of the pulse generator circuit; and (d) wave shaping means for shaping the triangular wave output voltage of the capacitor into a series of pulses.

5. The discharge lamp lighting system of claim 4 wherein the frequency control signal generated by the frequency control signal generator circuit of the inverter control means is a variable voltage signal indicative, by its own magnitude, of the repetition rate of the output pulses of the variable frequency pulse generator circuit, and wherein the charging circuit of the inverter control means comprises means for controlling the charging of the capacitor of the pulse generator circuit according to the voltage of frequency control signal.

6. The discharge lamp lighting system of claim 4 wherein the overriding frequency control means comprises a switch connected in parallel with the capacitor of the variable frequency pulse generator circuit and adapted to be rendered conductive in the event of phase advancement of the load current.

7. The discharge lamp lighting system of claim 2 wherein the phase advance detector means comprises:

(a) a current detector for providing a voltage signal indicative of the current flowing through the load circuit;

(b) a first comparator for comparing the output voltage of the current detector with a positive reference voltage;

(c) a second comparator for comparing the output voltage of the current detector with a negative reference voltage;

(d) a first flip flop having a first input connected to the first comparator, and a second input connected to the inverter control means for inputting one of the switch control signals;

(e) a second flip flop having a first input connected to the second comparator, and a second input connected to the inverter control means for inputting the other of the switch control signals;

(f) a first logic circuit having a first input connected to the first comparator, and a second input connected to the first flip flop; and (g) a second logic circuit having a first input connected to the second comparator, and a second input connected to the second flip flop.

8. The discharge lamp lighting system of claim 7 wherein the variable frequency pulse generator circuit of the inverter control means comprises:

(a) a capactor for providing a triangular wave voltage;

(b) a charging circuit for charging the capacitor of the pulse generator circuit;

(c) discharging means for discharging the capacitor of the pulse generator circuit; and (d) wave shaping means for shaping the triangular wave output voltage of the capacitor into a series of pulses;

and wherein the overriding frequency control means comprises:

(a) a first switch connected in parallel with the capacitor of the pulse generator circuit and adapted to be turned on and off by the first logic circuit of the phase advance detector means; and (b) a second switch connected in parallel with the capacitor of the pulse generator circuit and adapted to be turned on and off by the second logic circuit of the phase advance detector means.

9. The discharge lamp lighting system of claim 2 wherein the phase advance detector means comprises:

(a) a current detector for providing a voltage signal indicative of the current flowing through the load circuit;

(b) a comparator for comparing the output voltage of the current detector with a reference voltage;

(c) a flip flop having a first input connected to the comparator, and a second input connected to the inverter control means for inputting one of the switch control signals; and (f) a logic circuit having a first input connected to the comparator, and a second input connected to the flip flop.

10. The discharge lamp lighting system of claim 9 wherein the variable frequency pulse generator circuit of the inverter control means comprises:

(a) a capactor for providing a triangular wave voltage;

(b) a charging circuit for charging the capacitor of the pulse generator circuit;

(c) discharging means for discharging the capacitor of the pulse generator circuit; and (d) wave shaping means for shaping the triangular wave output voltage of the capacitor into a series of pulses;

and wherein the overriding frequency control means comprises:

(a) a switch connected in parallel with the capacitor of the pulse generator circuit and adapted to be turned on and off by the logic circuit of the phase advance detector means.

11. The discharge lamp lighting system of claim 9 wherein the variable frequency pulse generator circuit of the inverter control means comprises:

(a) a capactor for providing a triangular wave voltage;

(b) a charging circuit for charging the capacitor of the pulse generator circuit;

(c) discharging means for discharging the capacitor of the pulse generator circuit; and (d) wave shaping means for shaping the triangular wave output voltage of the capacitor into a series of pulses;

and wherein the overriding frequency control means comprises:

(a) an integrating circuit connected to the phase advance detector means for smoothing an output from the logic circuit; and (b) a switch connected to the charging circuit for modifying the charging of the capacitor in response to an output from the integrating circuit.

12. The discharge lamp lighting system of claim 2 wherein the phase advance detector means comprises:

(a) a current detector for providing a voltage signal indicative of a current flowing through one of the inverter switches;

(b) a comparator for comparing the output voltage of the current detector with a reference voltage;

(c) a flip flop having a first input connected to the comparator, and a second input connected to the inverter control means for inputting one of the switch control signals; and (f) a logic circuit having a first input connected to the comparator, and a second input connected to the flip flop.

13. The discharge lamp lighting system of claim 1 wherein the inverter circuit comprises:

(a) a pair of inverter switches interconnected in series and to be connected across a direct current power supply; and (b) coupling means for connecting one of the inverter switches in parallel with the load circuit.

14. The discharge lamp lighting system of claim 13 wherein the inverter circuit further comprises a pair of diodes each connected in parallel with, and oriented inversely to, one of the inverter switches.

15. The discharge lamp lighting system of claim 14 wherein the inverter circuit further comprises a pair of capacitors each connected in parallel with one of the inverter switches.

16. The discharge lamp lighting system of claim 14 wherein the inverter circuit further comprises a capacitor connected in parallel with one of the inverter switches.

17. The discharge lamp lighting system of claim 1 wherein the inverter circuit comprises:

(a) a pair of voltage-dividing capacitors interconnected in series and to be connected across a direct current power supply; and (b) a pair of inverter switches interconnected in series and connected in parallel with the serial circuit of the voltage-dividing capacitors;

(c) the load circuit being connected between a junction between the pair of voltage-dividing capacitors and a junction between the pair of inverter switches.

18. The discharge lamp lighting system of claim 1 wherein the inverter circuit comprises:

(a) a transformer primary winding having a center tap to be connected to one of a pair of outputs of a direct current power supply;

(b) a first inverter switch to be connected between one extremity of the transformer primary winding and the other of the outputs of the direct current power supply; and (c) a second inverter switch to be connected between another extremity of the transformer primary winding and said other output of the direct current power supply;

and wherein the load circuit includes a transformer secondary winding electromagnetically coupled to the transformer primary winding of the inverter circuit, the transformer secondary winding forming a part of the resonant circuit as inductor.

19. The discharge lamp lighting system of claim 1 wherein the inverter circuit comprises:

(a) a transformer primary winding having one extremity to be connected to one of a pair of outputs of a direct current power supply; and (b) an inverter switch to be connected between another extremity of the transformer primary winding and the other of the outputs of the direct current power supply;

and wherein the load circuit includes a transformer secondary winding electromagnetically coupled to the transformer primary winding of the inverter circuit, the transformer secondary winding forming a part of the resonant circuit as inductor.

20. The discharge lamp lighting system of claim 1 wherein the overriding frequency control means comprises an overriding frequency control circuit connected between the phase advance detector means and the inverter control means for causing the inverter control means to make the frequency of the output voltage of the inverter circuit higher than the resonance frequency ($f_0$) of the resonant circuit when the current flowing through the load circuit is ascertained to be in phase advance with respect to the output voltage of the inverter circuit, and for causing the inverter control means to make the frequency of the output voltage of the inverter circuit lower than the resonance frequency ($f_0$) of the resonant circuit when the current flowing through the load circuit is ascertained to be in phase delay with respect to the output voltage of the inverter circuit.

* * * * *